US007794221B2

(12) United States Patent
Dubey

(10) Patent No.: US 7,794,221 B2
(45) Date of Patent: Sep. 14, 2010

(54) EMBEDMENT DEVICE FOR FIBER REINFORCED STRUCTURAL CEMENTITIOUS PANEL PRODUCTION

(75) Inventor: Ashish Dubey, Grayslake, IL (US)

(73) Assignee: United States Gypsum Company, Chicago, IL (US)

( * ) Notice: Subject to any disclaimer, the term of this patent is extended or adjusted under 35 U.S.C. 154(b) by 567 days.

(21) Appl. No.: 11/692,540

(22) Filed: Mar. 28, 2007

(65) Prior Publication Data

US 2008/0241295 A1 Oct. 2, 2008

(51) Int. Cl.
*B28B 1/26* (2006.01)

(52) U.S. Cl. ..... 425/84; 264/86

(58) Field of Classification Search ..... 425/84; 264/86

See application file for complete search history.

(56) References Cited

U.S. PATENT DOCUMENTS 3,222,434 A * 12/1965 Stedman ..... 264/426
4,362,483 A * 12/1982 DeSantis ..... 425/78
4,420,295 A 12/1983 Clear et al.
4,450,022 A 5/1984 Galer
4,490,070 A 12/1984 Upchurch et al.
4,504,335 A 3/1985 Galer
4,530,653 A * 7/1985 Ishii ..... 425/363
4,705,702 A 11/1987 Shimada et al.
4,800,054 A * 1/1989 Roestenberg ..... 264/86
5,209,968 A 5/1993 Sweeney
5,452,968 A 9/1995 Dlugosz
5,462,642 A 10/1995 Kajander
5,685,903 A 11/1997 Stav et al.
5,858,083 A 1/1999 Stav et al.
5,958,131 A 9/1999 Asbridge et al.
6,054,022 A 4/2000 Helwig et al.
6,054,205 A 4/2000 Newman et al.

(Continued)

FOREIGN PATENT DOCUMENTS

WO 2005032783 A1 4/2005

OTHER PUBLICATIONS

Non-published U.S. Appl. No. 11/555,647 to Frank et al., filed Nov. 1, 2006.

(Continued)

*Primary Examiner*—Maria Veronica D Ewald
(74) *Attorney, Agent, or Firm*—Novak Druce + Quigg LLP

(57) ABSTRACT

An embedment device for use in a cementitious panel production line such as a structural cementitious panel (SCP) production line wherein hydraulic cement slurry is transported on a moving web on a support frame, and chopped fibers are deposited upon the slurry. The device includes as one embodiment, a wire grid structure mounted on a reciprocating shaft driven by a piston which moves the grid down into the slurry and then up out of the slurry transverse of the travel of the slurry layer on the web. An alternative embodiment device includes a grid cell structure with thin walls extending upward from the grid surface in contact with the slurry that is moved up and down in a reciprocating motion transverse of the travel of the slurry layer on the web. The intermeshing relationship of the grid cell with the fiber and slurry enhances embedment of the fibers into the slurry and also prevents clogging of the device by fibers and prematurely set slurry particles.

24 Claims, 9 Drawing Sheets

U.S. PATENT DOCUMENTS

| | | | |
|---|---|---|---|
| 6,176,920 | B1 | 1/2001 | Murphy et al. |
| 6,620,487 | B1 | 9/2003 | Tonyan et al. |
| 6,926,853 | B2 | 8/2005 | Hinc et al. |
| 6,986,812 | B2 | 1/2006 | Dubey et al. |
| 2002/0069950 | A1 | 6/2002 | Lynn et al. |
| 2003/0211305 | A1 | 11/2003 | Koval et al. |
| 2004/0084127 | A1 | 5/2004 | Porter |
| 2005/0064055 | A1 | 3/2005 | Porter |
| 2005/0064164 | A1 | 3/2005 | Dubey et al. |
| 2006/0144005 | A1 | 7/2006 | Tonyan et al. |
| 2006/0168905 | A1 | 8/2006 | Blanc et al. |
| 2006/0174572 | A1 | 8/2006 | Tonyan et al. |
| 2006/0185267 | A1 | 8/2006 | Tonyan et al. |
| 2007/0110838 | A1 | 5/2007 | Porter |
| 2007/0110970 | A1 | 5/2007 | Dubey |

OTHER PUBLICATIONS

Non-published U.S. Appl. No. 11/555,655 to George et al., filed Nov. 1, 2006.

Non-published U.S. Appl. No. 11/555,661 to Stivender, filed Nov. 1, 2006.

Non-published U.S. Appl. No. 11/555,665 to Frank et al., filed Nov. 1, 2006.

Non-published U.S. Appl. No. 11/555,658 to Frank et al., filed Nov. 1, 2006.

* cited by examiner

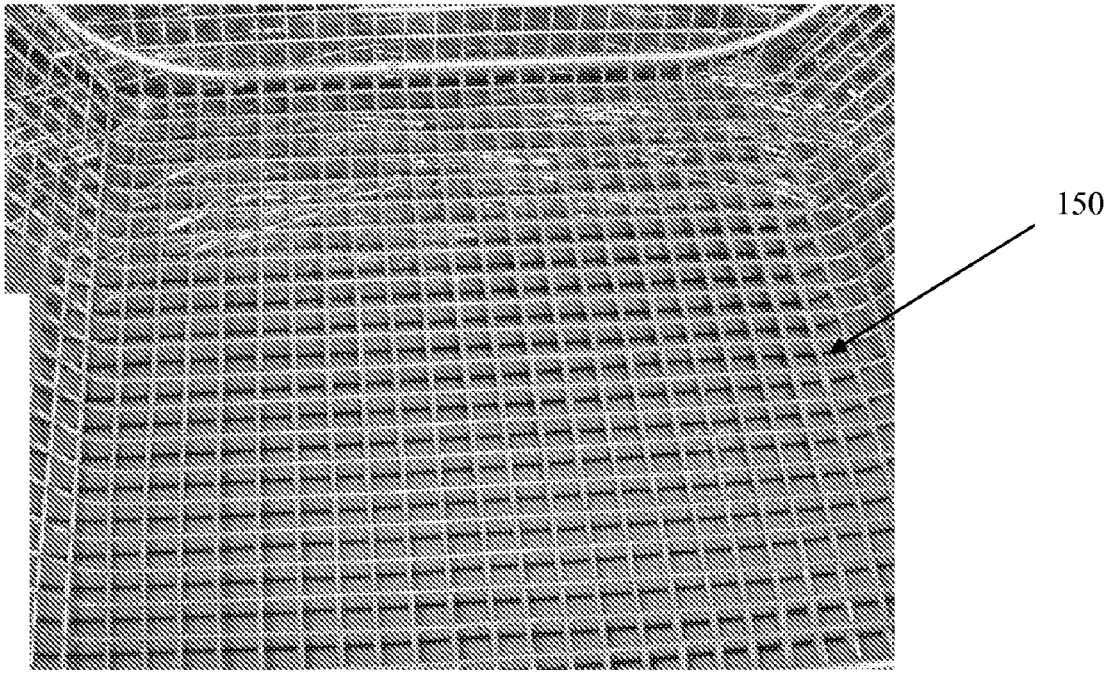
FIG. 2: Wire Grid Fiber Embedment Device
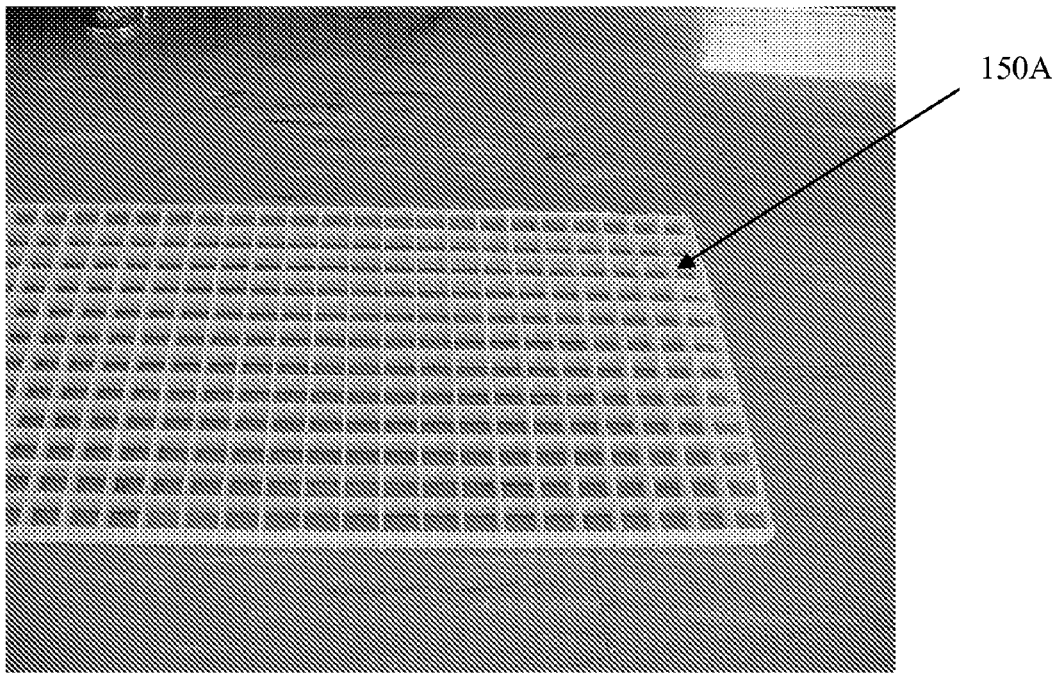
FIG. 3: GRID Cell Fiber Embedment Device

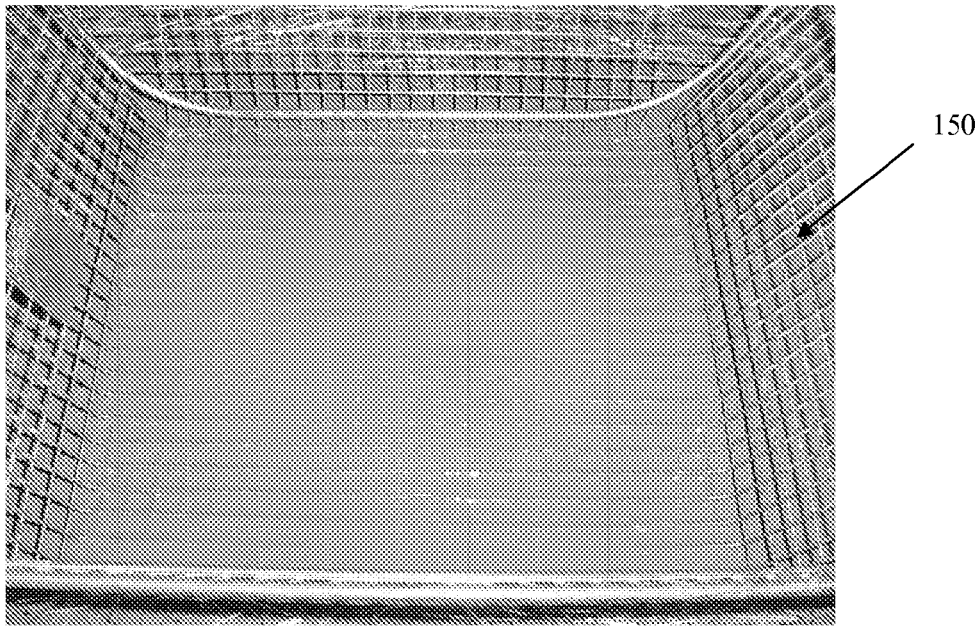
FIG. 4: Slurry oozing out through the wire grid network with the use of the wire grid fiber embedment device
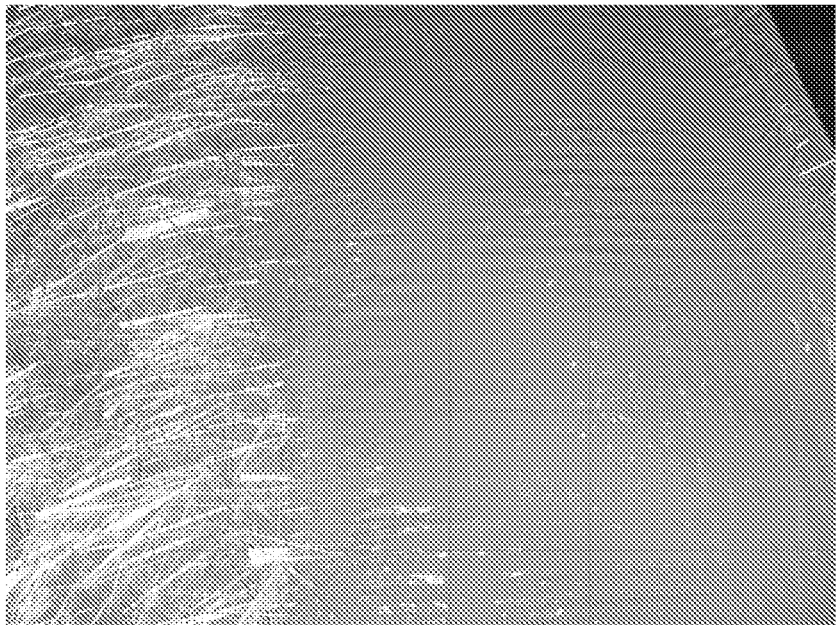
FIG. 5: Panel surface subsequent to the use of the wire grid fiber embedment device FIG. 7 FLEXURAL STRENGTH (MODULUS of Rupture, 28-day oven dry) As A Function Fiber Embedment Method For Panels Manufactured Using Distinct Slurry And Fiber Layers.
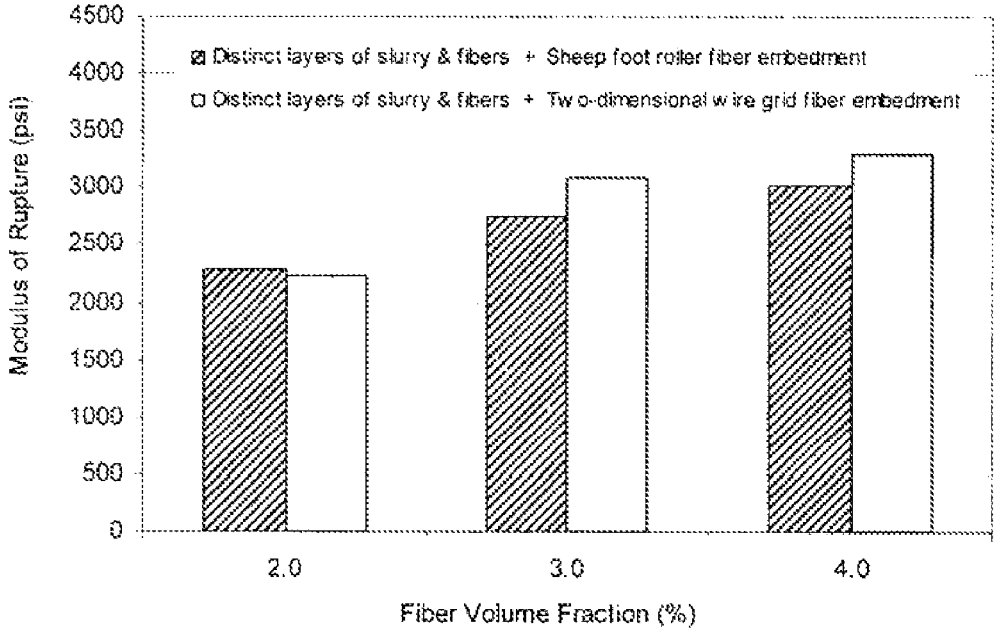

FIG. 8 FLEXURAL STRENGTH (MODULUS of Rupture, 28-day oven dry) As A Function Fiber Embedment Method For Panels Manufactured Using The Following Two Approaches:
(1) Simultaneous Spray OF Slurry And Fibers - Sheep Foot Roller Fiber Embedment Method..
(2) Distinct Layers Of Slurry And Fiber – Wire Grid Fiber Embedment Method of This Invention.
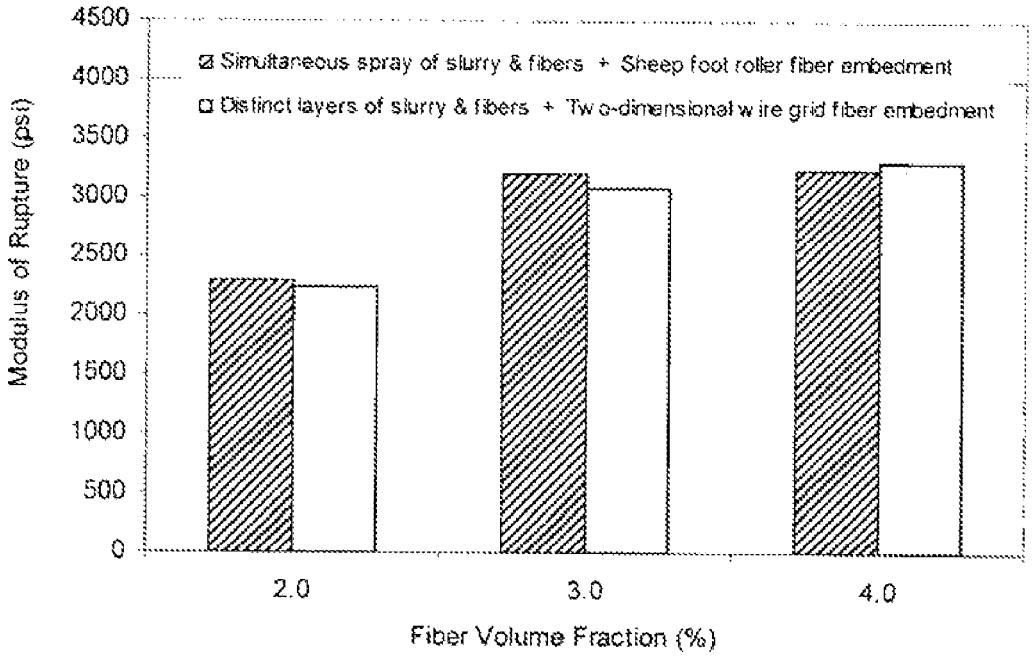

EMBEDMENT DEVICE FOR FIBER REINFORCED STRUCTURAL CEMENTITIOUS PANEL PRODUCTION

CROSS REFERENCE TO RELATED APPLICATIONS

This application is related to co-pending patent applications:

U.S. Pat. No. 6,986,812 entitled SLURRY FEED APPARATUS FOR FIBER-REINFORCED STRUCTURAL CEMENTITIOUS PANEL PRODUCTION, issued on Jan. 17, 2006;

U.S. application Ser. No. 10/666,294, now U.S. Pat. No. 7,445,738, entitled APPARATUS FOR PRODUCING HIGH STRENGTH FIBER-REINFORCED STRUCTURAL CEMENTITIOUS PANELS, filed Sep. 18, 2003;

U.S. application Ser. No. 11/555,647, entitled PROCESS AND APPARATUS FOR FEEDING CEMENTITIOUS SLURRY FOR FIBER-REINFORCED STRUCTURAL CEMENT PANELS, filed Nov. 1, 2006;

U.S. application Ser. No. 11/555,655, now U.S. Pat. No. 7,524,386, entitled METHOD FOR WET MIXING CEMENTITIOUS SLURRY FOR FIBER-REINFORCED STRUCTURAL CEMENT PANELS, filed Nov. 1, 2006;

U.S. application Ser. No. 11/555,661, entitled PANEL SMOOTHING PROCESS AND APPARATUS FOR FORMING A SMOOTH CONTINUOUS SURFACE ON FIBER-REINFORCED STRUCTURAL CEMENT PANELS, filed Nov. 1, 2006;

U.S. application Ser. No. 11/555,665, now U.S. Pat. No. 7,475,599, entitled WET SLURRY THICKNESS GAUGE AND METHOD FOR USE OF SAME, filed Nov. 1, 2006;

U.S. application Ser. No. 11/591,793, entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT, filed Nov. 1, 2006; and U.S. application Ser. No. 11/591,957, now U.S. Pat. No. 7,513,768, entitled EMBEDMENT ROLL DEVICE, filed Nov. 1, 2006, all herein incorporated by reference in their entirety.

FIELD OF THE INVENTION

This invention relates generally to devices for embedding fibers in settable slurries, and specifically to a device designed for embedding fibers in a settable cement slurry along a cement board or cementitious structural panel ("SCP") production line.

BACKGROUND OF THE INVENTION

Cementitious panels have been used in the construction industry to form the interior and exterior walls of residential and/or commercial structures. The advantages of such panels include resistance to moisture compared to standard gypsum-based wallboard.

Typically, the cementitious panel includes at least one hardened cement or plaster composite layer between layers of a reinforcing or stabilizing material. In some instances, the reinforcing or stabilizing material is fiberglass mesh or the equivalent. The mesh is usually applied from a roll in sheet fashion upon or between layers of settable slurry. Examples of production techniques used in conventional cementitious panels are provided in U.S. Pat. Nos. 4,420,295; 4,504,335 and 6,176,920, the contents of which are incorporated by reference herein. Further, other gypsum-cement compositions are disclosed generally in U.S. Pat. Nos. 5,685,903; 5,858,083 and 5,958,131.

A goal when producing cementitious panels is to properly and uniformly distribute in the slurry the fibers, applied in a mat or web. Due to non-uniform distribution the reinforcing properties resulting due to the fiber-matrix interaction vary through the thickness of the board, depending on the thickness of each board layer. When insufficient penetration of the slurry through the fiber network occurs, poor bonding between the fibers and the matrix results, causing low panel strength. Also, in some cases when distinct layering of slurry and fibers occurs, improper bonding and inefficient distribution of fibers causes poor panel strength development.

In instances, such as disclosed in commonly-assigned U.S. application Ser. No. 10/666,294, entitled MULTI-LAYER PROCESS AND APPARATUS FOR PRODUCING HIGH STRENGTH FIBER-REINFORCED STRUCTURAL CEMENTITIOUS PANELS, filed Sep. 18, 2003, where loose chopped fiberglass fibers are mixed with the slurry to provide a cementitious structural panel (SCP) having structural reinforcement, it would be desirable to provide new devices to further ensure uniform mixing of the fibers and slurry. Such uniform mixing is important for achieving the desired structural strength of the resulting panel or board.

Also, production line downtime, caused by premature setting of the slurry, especially in particles or clumps which impair the appearance of the resulting board, increases cementitious panel production costs, causes structural weaknesses and interferes with production equipment efficiency. Significant buildups of prematurely set slurry on production equipment require shutdowns of the production line, thus increasing the ultimate board cost.

Another design criteria of devices used to mix chopped reinforcing fibers into a slurry is that the fibers need to be mixed into the relatively thick slurry in a substantially uniform manner to provide the required strength.

Thus, there is a need for a device for more reliably thoroughly mixing fiberglass or other structural reinforcing fibers into settable slurry so that the device does not become clogged or impaired by chunks or setting slurry.

SUMMARY OF THE INVENTION

The above-listed needs are met or exceeded by the present invention that features an embedment device including a wire grid member or a honeycomb or grid cell structure disposed transversely on the fiber-enhanced settable slurry board production line. During board production, the wire grid member or the honeycomb or grid cell structure is moved vertically up and down into the fiber and slurry layer in a reciprocating motion to a specific depth in the slurry to press the fiber and slurry together, and then is removed. The vertical motion thus pushes the top layer of fiber into the slurry while allowing the slurry to "ooze" through the grid structure. The reciprocating motion of the grid structures create a "kneading" or "massaging" action in the slurry, which embeds previously deposited fibers into the slurry. In addition, the close, intermeshed and thin walled structure of the wire grid or thin walled grid cell structure prevents the buildup of slurry on the grid, and in effect creates a "self-cleaning" action which significantly reduces board line downtime due to premature setting of clumps of slurry.

More specifically, the invention provides an embedment device for use in a cementitious panel production line wherein a slurry is transported on a moving carrier relative to a support frame, and chopped fibers are deposited upon the slurry.

Included on the device is a frame support on both sides of the grid for mounting on a reciprocating arm such as a piston driven arm attached to the side supports of the traveling conveyer belt so the grid can be moved up and down into the slurry and fiber traveling transverse to the embedment device.

In a preferred embodiment, the embedment device is a stainless steel wire grid having a minimum third dimension so sticking of the slurry to the grid walls is reduced. The embedment device can be moved up and down by a piston that is driven by a separate electric motor, or it can be run pneumatically, hydraulically or manually.

BRIEF DESCRIPTION OF THE DRAWINGS

FIG. 1 D is a perspective view of another embodiment of the embedment device that is mounted over the conveyor belt with rotatable arms driven by an electric motor that rotate the grid cell in a crank and slider reciprocating motion.

FIG. 2 is an overhead photograph of the wire grid structure embodiment of the embedment device of the invention.

FIG. 3 is a photograph of the grid cell structure embodiment of the invention.

FIG. 4 is a photograph of the wire grid embedment device of the invention pressed into the fiber and slurry layer formed on the production line of FIG. 1.

FIG. 5 is a photograph of the fiber embedded slurry produced through use of the grid fiber embedment device of FIG. 4.

FIG. 7 is a bar graph of the Flexural Strength as a function of fiber embedment method use for making panels using distinct slurry and fiber layers and comparing wire grid embedment device versus sheep foot rollers.

FIG. 8 is a bar graph of Flexural Strength as a function of the fiber embedment method used for making panels with simultaneous spraying of slurry and fiber using sheep foot roller devices and use of wire grid embedment method with distinct layers of slurry and fiber.

DETAILED DESCRIPTION OF THE INVENTION

Figure 1:
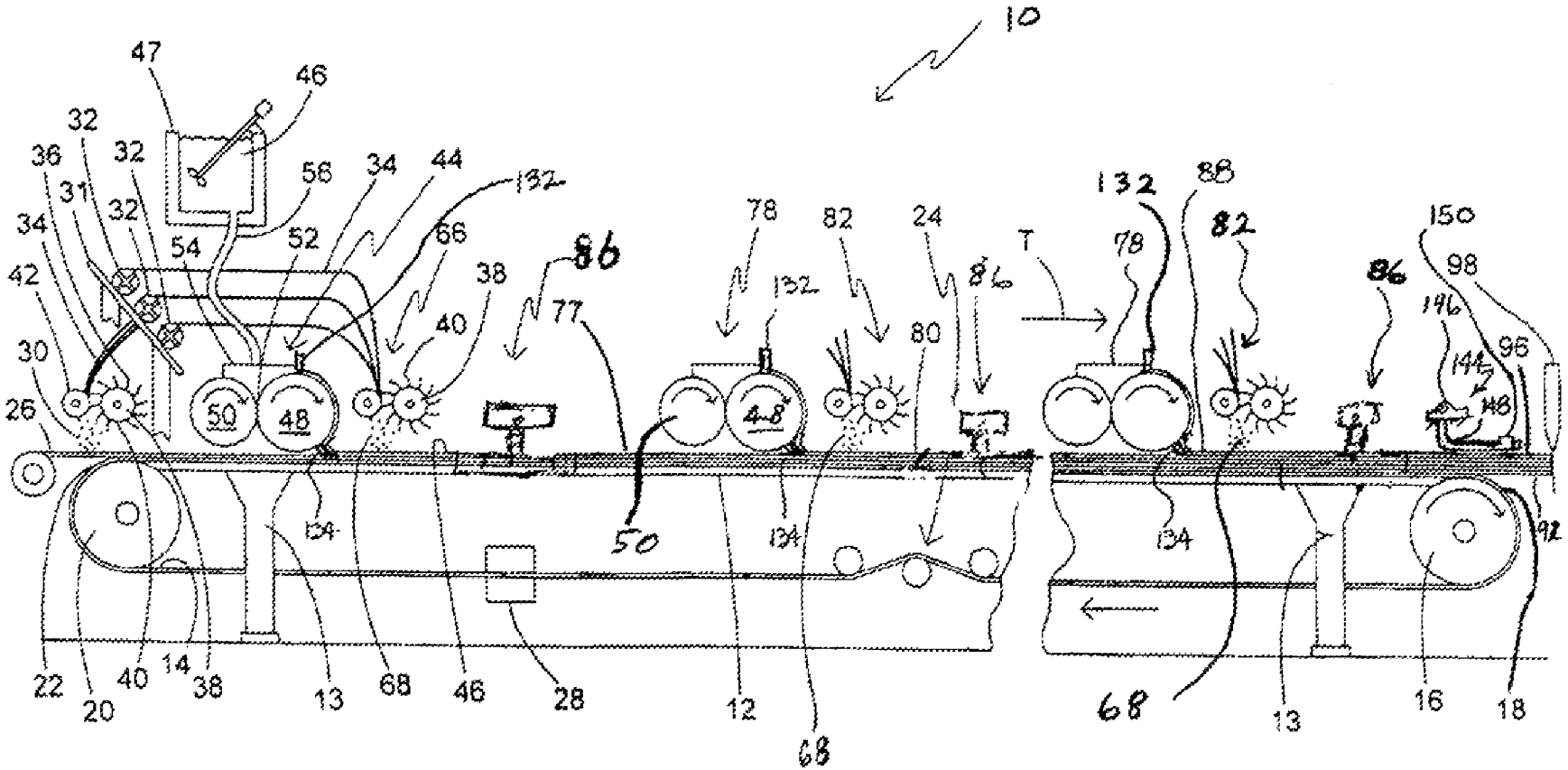
FIG. 1 is a perspective view of a cementitious panel (SCP) production line with an embodiment of an embedment device of the invention.

Referring now to FIG. 1, a cementitious panel production line is diagrammatically shown and is generally designated 10. The production line 10 includes a support frame or forming table 12 having a plurality of legs 13 or other supports. Included on the support frame 12 is a moving carrier 14, such as an endless rubber-like conveyor belt with a smooth, water-impervious surface, however porous surfaces are contemplated. As is well known in the art, the support frame 12 may be made of at least one table-like segment, which may include designated legs 13 or other support structure. The support frame 12 also includes a main drive roll 16 at a distal end 18 of the frame, and an idler roll 20 at a proximal end 22 of the frame. Also, at least one belt tracking and/or tensioning device 24 is typically provided for maintaining a desired tension and positioning of the carrier 14 upon the rolls 16, 20. In this embodiment, the SCP panels are produced continuously as the moving carrier proceeds in a direction "T" from the proximal end 22 to the distal end 18.

In this embodiment, a web 26 of Kraft paper, release paper, or a plastic carrier, for supporting a slurry prior to setting, may be provided and laid upon the carrier 14 to protect it and/or keep it clean.

However, it is also contemplated that, rather than the continuous web 26, individual sheets (not shown) of a relatively rigid material, e.g., sheets of polymer plastic, may be placed on the carrier 14.

It is also contemplated that the SCP panels produced by the present line 10 are formed directly upon the carrier 14. In the latter situation, at least one belt washing unit 28 is provided. The carrier 14 is moved along the support frame 12 by a combination of motors, pulleys, belts or chains which drive the main drive roll 16 as is known in the art. It is contemplated that the speed of the carrier 14 may vary to suit the product being made.

Chopper

In a conventional cementitious panel production line, e.g. a structural cement panel (SCP panel), production is initiated by depositing a layer of loose, chopped fibers 30 of about one inch in size upon a plastic carrier on the web 26. A variety of fiber depositing and chopping devices are contemplated by the present line 10. For example, a typical system employs a rack 31 holding several spools 32 of fiberglass cord, from each of which a length or string 34 of fiber is fed to a chopping station or apparatus, also referred to as a chopper 36. Typically a number of strands of fiberglass are fed at each of the chopper stations.

The chopper 36 includes a rotating bladed roll 38 from which project radially extending blades 40 extending transversely across the width of the carrier 14, and which is disposed in close, contacting, rotating relationship with an anvil roll 42. In the preferred embodiment, the bladed roll 38 and the anvil roll 42 are disposed in relatively close relationship such that the rotation of the bladed roll 38 also rotates the anvil roll 42, however the reverse is also contemplated. Also, the anvil roll 42 is preferably covered with a resilient support material against which the blades 40 chop the cords 34 into segments. The spacing of the blades 40 on the roll 38 determines the length of the chopped fibers. As is seen in FIG. 1, the chopper 36 is disposed above the carrier 14 near the proximal end 22 to maximize the productive use of the length of the production line 10. As the fiber strands 34 are chopped, the fibers fall loosely upon the carrier web 26.

Slurry Mixer

To prepare and feed slurry the present production line 10 includes a feed station or slurry feeder or slurry headbox, generally designated 44 and a source of slurry, which in this embodiment is a wet mixer 47. The slurry feeder 44 receives a supply of slurry 46 from the wet mixer 47 for depositing the slurry 46 on chopped fibers on the carrier web 26. It is also contemplated that the process may begin with the initial deposition of slurry upon the carrier 14.

The cementitious slurry of the invention may be made from a core mix comprising water and a cementitious material i.e. a hydraulic cement that is able to set on hydration such as portland cement, magnesia cement, alumina cement, gypsum or blend thereof and an aggregate component selected from among mineral and non-mineral aggregates. The ratio of mineral aggregates to hydraulic cement may be in a ratio of 1:6 to 6:1. The ration of non-mineral aggregate to hydraulic cement may be a ratio of 1:100 to 6:1.

The core mix may be composed of a lightweight mineral and/or organic aggregate such as sand, expanded clay, expanded shale, expanded perlite, expanded vermiculite, expanded closed cell glass beads, closed cell polystyrene beads.

While a variety of settable cementitious slurries are contemplated, the present process is particularly designed for producing structural cementitious panels (SCP panels). As such, the slurry 46 preferably comprises varying amounts of Portland cement, gypsum, aggregate, water, accelerators, plasticizers, foaming agents, fillers and/or other ingredients well known in the art, and described in the patents listed below which have been incorporated by reference. The relative amounts of these ingredients, including the elimination of some of the above or the addition of others, may vary to suit the intended use of the final product.

U.S. Pat. No. 6,620,487 to Tonyan et al., incorporated herein by reference in its entirety, discloses a reinforced, lightweight, dimensionally stable structural cement panel (SCP) which employs a core of a continuous phase resulting from the curing of an aqueous mixture of calcium sulfate alpha hemihydrate, hydraulic cement, an active pozzolan and lime. The continuous phase is reinforced with alkali-resistant glass fibers and containing ceramic microspheres, or a blend of ceramic and polymer microspheres, or being formed from an aqueous mixture having a weight ratio of water-to-reactive powder of 0.6/1 to 0.7/1 or a combination thereof. At least one outer surface of the SCP panels may include a cured continuous phase reinforced with glass fibers and containing sufficient polymer spheres to improve nailability or made with a water-to-reactive powders ratio to provide an effect similar to polymer spheres, or a combination thereof.

If desired the composition may have a weight ratio of water-to-reactive powder of 0.4/1 to 0.7/1.

Various formulations for the composite slurry used in the current process are also shown in published US applications US2006/185267, US2006/0174572; US2006/0168905 and US 2006/0144005, all of which are incorporated herein by reference in their entirety. A typical formulation would comprise as the reactive powder, on a dry basis, 35 to 75 wt. % calcium sulfate alpha hemihydrate, 20 to 55 wt. % hydraulic cement such as Portland cement, 0.2 to 3.5 wt. % lime, and 5 to 25 wt. % of an active pozzolan. The continuous phase of the panel would be uniformly reinforced with alkali-resistant glass fibers and would contain 20-50% by weight of a uniformly distributed lightweight filler particles selected from the group consisting of ceramic microspheres, glass microspheres, fly ash cenospheres and perlite. Although the above compositions for the SCP panels are preferred, the relative amounts of these ingredients, including the elimination of some of the above or the addition of others, may vary to suit the intended use of the final product.

An embodiment of the wet powder mixer 47 is shown in FIG. 1, FIG. 2, FIG. 3 and FIG. 4 of U.S. application Ser. No. 11/555,655, entitled METHOD FOR WET MIXING CEMENTITIOUS SLURRY FOR FIBER-REINFORCED STRUCTURAL CEMENT PANELS, filed Nov. 1, 2006, incorporated herein by reference.

A powder mixture of Portland cement, gypsum, aggregate, fillers, etc. is fed from an overhead hopper bin through a bellows to a horizontal chamber which has an auger screw driven by a side mounted auger motor. The solids may be fed from the hopper bin to the auger screw by a volumetric feeder or a gravimetric feeder (not shown).

Volumetric feeding systems would use an auger screw conveyor running at a constant speed to discharge powder from the storage hopper bin at a constant rate (volume per unit time, e.g., cubic feet per minute. Gravimetric feeding systems generally use a volumetric feeder associated with a weighing system to control the discharge of powder from the storage hopper bin at a constant weight per unit of time, e.g., pounds per minute. The weight signal is used via a feedback control system to constantly monitor the actual feed rate and compensate for variations in bulk density, porosity, etc. by adjusting the speed (RPM) of the auger screw.

The auger screw feeds the powder directly into the vertical mixing chamber through powder inlet located in an upper section of the vertical mixing chamber. Then the powder drops by gravity into the agitator equipped lower section of the vertical mixing chamber.

Liquid comprising water is simultaneously supplied to the vertical chamber by water inlets, e.g. nozzles, disposed around the perimeter of the upper portion of the chamber at a point below the inlet for the dry powder so that it also drops to the level of the agitator section of the vertical chamber. The direction of the individual water inlets can be manually adjusted to be directed on the paddle blades, etc. to maintain the surfaces free from powder build-up. The individual water inlets may be provided with valves. Dropping the powder and liquid separately into the vertical chamber advantageously avoids clogging at the inlet of the powder to the chamber, that might occur if the liquid and powder were mixed before entering the chamber, and permits feeding the powder directly into the vertical chamber using a smaller outlet for the auger than would be used if the liquid and powder were mixed before entering the chamber The water and powder are thoroughly mixed by a mixer paddle which has multiple paddle blades that are rotated on the paddle central shaft by a top mounted electric motor. The mixer is further illustrated in FIG. 5 of the above referenced U.S. application Ser. No. 11/555,655. The number of paddle blades on the central shaft and the configuration of the paddle blades including the number of horizontal bars used in each paddle blade can be varied. For example, vertically mounted pins may be added to the horizontal bars of the blades to enhance agitation of the slurry. Typically the bars are flat horizontal members, rather than angled, to reduce the vortex in the lower portion of the mixing chamber. In one embodiment, it has been found that a dual bladed paddle, with a lower number of horizontal bars can be used in view of the higher mixing speeds obtained in a typical 12 inch diameter vertical chamber of the present invention. The paddles for embodiments of the production line of the present invention for mixing SCP slurry are designed to accommodate the slurry and the diameter of the lower portion of the mixing chamber 165. Increasing the diameter of the lower portion of the mixing chamber results in increasing the transverse width of the paddle. The increased transverse width of the paddle increases its tip speed at a given RPM. This causes a problem because the paddle is more likely to fling the slurry to the outer edges of the vertical mixing chamber and create an undesirable deep vortex in the middle of the lower portion of the mixing chamber. The paddle of the present invention for being employed with SCP slurry is preferably designed to minimize this problem by minimizing the number of horizontal mixing bars and flattening the horizontal mixing bars to minimize turbulence while still ensuring adequate mixing.

The level of the slurry 46 in the vertical mixing chamber is controlled by electrical level control sensor disposed within the vertical mixing chamber. The control sensor controls the flow of water through electronically controlled valves and controls the powder feed into the vertical chamber by turning an auger motor on or off via a controller. The control of the volume of added water and slurry is thus used to control both the volume of the slurry in the vertical mixing chamber and the mixing residence time in the vertical mixing chamber. Once the slurry 46 is adequately mixed, it is pumped from the bottom of the vertical mixing chamber by the slurry pump to the slurry feeding apparatus 44 by means of pump outlet. The pump can be run by the paddle central shaft that is driven by the top mounted electric motor, or a separate pump motor could be used to drive the pump.

The mixing residence time of the powder and water in the vertical mixing chamber is important to the design of the vertical chamber. The slurry mixture 46 must be thoroughly mixed and be of a consistency that can be easily pumped and deposited uniformly over the much thicker fiberglass layer on the web.

To result in adequately mixed slurry 46, the vertical chamber provides a suitable mixing volume for an average slurry residence time of typically about 10 to about 360 seconds while the spinning paddle applies shear force to the slurry in the mixing chamber. Typically, the vertical chamber provides an average slurry residence time of about 15 to about 240 seconds. The RPM range of the mixer paddle is typically 70 RPM to 270 RPM. Other typical ranges for average slurry residence time are from about 15 seconds to about 30 seconds or about 20 seconds to about 60 seconds.

A typical embodiment of a vertical chamber of the mixer 47 has a nominal inside diameter of about 8 to 14 inches (20.3 to 35.6 cm) or 10 to 14 inches (25.4 to 35.6 cm), e.g., 12 inches (30.5 cm.), a total vertical height of about 20 to 30 inches (50.8 to 76.2 cm), e.g., about 25 inches (63.5 cm) and a vertical height below the control sensor of about 6 to 10 inches (15.2 to 25.4 cm), e.g. about 8 inches (20.3 cm.). As the diameter increases, the paddles should be designed to accommodate these larger diameters to minimize the vortex effect caused by increases paddle tip speed at a given RPM as discussed above. The outer tips of the paddles are generally designed to be close, e.g., within about a quarter inch (0.64 cm) or about an eighth inch (0.32 cm), of the inner walls of the chamber. Too great a distance between the paddle tips and the inner walls of the chamber would result in slurry build-up.

Additional details of the wet slurry mixer used to mix the slurry that is provided to the production line in FIG. 1 are disclosed in U.S. application Ser. No. 11/555,655 filed Nov. 1, 2006 and in U.S. application Ser. No. 11/555,658, filed Nov. 1, 2006, both of which are incorporated herein by reference in there entirety.

Slurry Feed Apparatus

Referring now to FIG. 1, as mentioned above, the present slurry feed apparatus, also referred to as a slurry feed station, a slurry feeder or slurry headbox, generally designated 44 receives a supply of slurry 46 from the wet mixer 47.

The preferred slurry feeder 44 includes a main metering roll 48 disposed transversely to the direction of travel "T" of the carrier 14. A companion or back up roll 50 is disposed in close, parallel, rotational relationship to the metering roll 48. Slurry 46 is deposited in a nip 52 between the two rolls 48, 50.

The slurry feeder 44 also has a gate 132 mounted to sidewalls of the slurry feed apparatus 44 to be mounted adjacent to the surface of the metering roll 48 to form a nip 55 therebetween. The gate 132 is above the metering roll 48 so that the nip 55 is between the gate 132 and an upper portion of the roll 48. The rolls 48, 50 and gate 132 are disposed in sufficiently close relationship that the nip 55 retains a supply of the slurry 46, at the same time the rolls 48, 50 rotate relative to each other. The gate 132 is provided with a vibrator (not shown). Further description of the gate is provided by U.S. application Ser. No. 11/555,647.

While other sizes are contemplated, typically the metering roll 48 has a larger diameter than the companion roll 50.

Also, typically one of the rolls 48, 50 has a smooth, stainless steel exterior, and the other, preferably the companion roll 50, has a resilient, non-stick material covering its exterior.

In particular, the gate 132 comprises a blade mounted to a vibrating gate support shaft/bar (not shown) and, optionally a stiffening member (not shown) mounted to the vibrating gate support shaft/bar. The gate blade is typically made of 16-12 gauge stainless sheet metal.

The stiffening member is attached to the backside of the vibrating gate support shaft and vibrating gate 132. The gate 132 is vibrated by means of a rotary vibrator mounted on a stiffening channel/member on the—backside—of the gate. A piece of flat stock that "clamps" the sheet metal gate to the gate support shaft (aluminum square stock).

If the stiffening member is not provided then the rotary vibrator may be attached to the gate support shaft or other suitable portion of the gate 132. The vibrating means is typically a pneumatic rotary ball vibrator. The level of vibration can be controlled with a conventional air regulator (not shown).

The stiffening member functions not only to stiffen the slurry gate, but, by mounting the vibratory unit on this stiffening member, this distributes the vibration across the length of the device more evenly. For example, if we mount the vibratory unit directly to the slurry gate, without the stiffening member, the vibration from the vibratory unit would be highly localized at the mounting point, with relatively little vibration out on the edges of the sheet. This is not to say that the vibratory unit cannot be mounted anywhere besides the stiffening member, but it is a preferred location since a stiffening member is typically employed and it does a good job of equally distributing the vibration.

The gate 132 may be mounted to the sidewalls 54 of the headbox 44 by a support system (not shown) to permit the position of the blade to be adjusted the horizontally, vertically as well. The support system includes a pivot pin attached, respectively, to each end of the gate support shaft and seated in an adjustable mount attached to a sidewall of the slurry feed apparatus. An embodiment of the adjustable mount has a pivot yoke seated in a U-shaped member. Screws pass through the upwardly extending legs of the U-shaped mount to permit forward and backwards adjustment of the position of the pivot yoke, and in turn the gate 132. Also, bolts are provided through holes of the U-shaped member for permitting up and down adjustment of the position of the pivot yoke, and in turn the gate 132.

Preferably, the vibrating gate 132 may be pivotally adjusted to vary the gap between the gate 132 and the metering roll 48 by means of an pivoting adjustment system (not shown).

The vibrating gate 132 helps to prevent significant build-up of slurry 46 on the gate 132 and controls the thickness of the slurry 46 deposited on the metering roll 48. The vibrating gate 132 can easily be removed from the wall mounts for cleaning and maintenance.

Additional details of the slurry feeder (headbox) 44 are disclosed in U.S. application Ser. No. 11/555,647, filed Nov. 1, 2006 and incorporated herein by reference in its entirety.

Typically the slurry feeder 44 has a pair of relatively rigid sidewalls (not shown), preferably made of, or coated with non-stick material such as TEFLON® material or the like. The sidewalls prevent slurry 46 poured into the nip 52 from escaping out the sides of the slurry feeder 44. The sidewalls which are preferably secured to the support frame 12 (FIG. 1), are disposed in close relationship to ends of the rolls 48, 50 to retain the slurry 46. However, the sidewalls are not excessively close to ends of the rolls to interfere with roll rotation.

The slurry feeder 44 deposits an even layer of the slurry 46 of relatively controlled thickness upon the moving carrier web 26. Suitable layer thicknesses range from about 0.08 inch to 0.16 inch or 0.25 inch. However, with four layers preferred in the structural panel produced by the production line 10, and a suitable building panel being approximately 0.5 inch, an especially preferred slurry layer thickness is in the range of 0.125 inch. However, for a target panel forming thickness is about 0.84", the standard layer thickness is typically closer to about 0.21 inches at each of the 4 forming stations. A range of 0.1 inch to 0.3 inch per headbox may also be suitable.

Thus, the relative distance between the vibrating gate 132 and the main metering roll 48 may be adjusted to vary the thickness of the slurry 46 deposited. The nip distance between the gate 132 and the metering roll 48 is typically maintained at a distance of about ⅛ to about ⅜ inches (about 0.318 to about 0.953 cm). However, this can be adjusted based upon the viscosity and thickness of the slurry 46 and the desired thickness of the slurry to be deposited on the web 26.

To ensure a uniform disposition of the slurry 46 across the entire web 26, the slurry 46 is delivered to the slurry feeder 44 through a hose 56 or similar conduit having a first end in fluid communication with the outlet of the slurry mixer or reservoir 47. A second end of the hose 56 is connected to a laterally reciprocating, cable driven, fluid-powered dispenser of a type well known in the art. Slurry flowing from the hose 56 is thus poured into the feeder 44 in a laterally reciprocating motion to fill a reservoir defined by the rolls 48, 50 and the sidewalls of the slurry feeder 44. Rotation of the metering roll 48 draws a layer of slurry 46 from the reservoir.

The reciprocating dispensing mechanism is explained in greater detail in U.S. application Ser. No. 11/555,647, entitled PROCESS AND APPARATUS FOR FEEDING CEMENTITIOUS SLURRY FOR FIBER-REINFORCED STRUCTURAL CEMENT PANELS, filed Nov. 1, 2006 and incorporated herein by reference in its entirety as well as U.S. Pat. No. 6,986,812 to Dubey et al. incorporated herein by reference in its entirety.

Another feature of the feeder apparatus 44 is that the main metering roll 48 and the companion roll 50 are both driven in the same direction which minimizes the opportunities for premature setting of slurry on the respective moving outer surfaces. A drive system (not shown), including a fluid-powered, electric or other suitable motor is connected to the main metering roll 48 or the companion roll 50 for driving the roll(s) in the same direction, which is clockwise when viewed in the production line in current FIG. 1. As is well known in the art, either one of the rolls 48, 50 may be driven, and the other roll may be connected via pulleys, belts, chain and sprockets, gears or other known power transmission technology to maintain a positive and common rotational relationship.

As the slurry 46 on the outer surface 70A moves toward the moving carrier web 26, it is important that all of the slurry be deposited on the web, and not travel back upward toward the nip 52. Such upward travel would facilitate premature setting of the slurry 46 on the rolls 48, 50 and would interfere with the smooth movement of slurry from the reservoir to the carrier web 26.

To assist in this, the slurry feeder 44 has a doctor blade 134 as further described in U.S. application Ser. No. 11/555,647 filed Nov. 1, 2006) located between the main metering roll 48 and the carrier web 26 to ensure that the relatively thin slurry 46 is completely deposited as a continuous curtain or sheet of slurry is uniformly directed down to within a distance of about 1.0 to about 1.5 inches (2.54 to 3.81 cm.) of the carrier web 26. The doctor blade 134 ensures the slurry 46 uniformly covers the fiberglass fiber layer upon the carrier web 26 and does not proceed back up toward the nip 52 and the feeder reservoir. The doctor blade 134 also helps keep the main metering roll 50 free of prematurely setting slurry 46.

The doctor blade is an improvement over prior art stripping wires used in early slurry feeding systems and which allowed thinner slurries to deposit as drops of slurry on the web.

The doctor blade 134 is mounted on a doctor blade support shaft (not shown) mounted on a doctor blade tension arm pivotably mounted to adjustable pivot mount attached to the support frame or sidewall of the slurry feeder 44. A shaft or bar is attached to the sidewalls of the slurry feeder 44 above the metering roller 48. The doctor blade 134 is biased towards the roll 48 by a tensioning spring having a first end attached to the shaft or bar and a second end attached to the free end of the doctor blade tension arm. Thus, the doctor blade 134 is held in a position adjacent to the outer surface of the metering roll 48 by the tensioning arm and tensioning spring. The position of the doctor blade 134 can be adjusted by adjusting the adjustable pivot mount attached to the support frame or sidewall of the slurry feeder 44.

The doctor blade 134 removes the slurry from the surface of the metering roll 48 like the wire used in the process of U.S. Pat. No. 6,986,812 to Dubey et al. The doctor blade 134 also serves to collect the slurry 46 in a uniform layer or curtain and downwardly directs the slurry 46 in the direction of the movement of the web to a point about 1.0 to 1.5 inches (92.54 to 3.81 cm.) over the fiberglass layer on the web to uniformly cover the fiberglass layer with the slurry 46. This is particularly important where thinner slurries are used to cover the fiberglass layer, since thinner slurries have a tendency to drip over wires.

The doctor blade 134 is explained in greater detail in U.S. application Ser. No. 11/555,647, entitled PROCESS AND APPARATUS FOR FEEDING CEMENTITIOUS SLURRY FOR FIBER-REINFORCED STRUCTURAL CEMENT PANELS, filed Nov. 1, 2006 and incorporated herein by reference in its entirety.

Processing Downstream of the Slurry Feed Apparatus

Referring again to FIG. 1, the other operational components of the SCP panel production line will be described briefly, but they are described in more detail in the following documents:

U.S. Pat. No. 6,986,812 to Dubey et al., entitled SLURRY FEED APPARATUS FOR FIBER-REINFORCED STRUCTURAL CEMENTITIOUS PANEL PRODUCTION, herein incorporated by reference in its entirety; and the following co-pending, commonly assigned, United States patent applications all herein incorporated by reference in their entirety:

United States Patent Application Publication No. 2005/0064164 A1 to Dubey et al., application Ser. No. 10/666,294, entitled, MULTI-LAYER PROCESS AND APPARATUS FOR PRODUCING HIGH STRENGTH FIBER-REINFORCED STRUCTURAL CEMENTITIOUS PANELS;

United States Patent Application Publication No. 2005/0064055 A1 to Porter, U.S. application Ser. No. 10/665,541, entitled EMBEDMENT DEVICE FOR FIBER-ENHANCED SLURRY;

U.S. application Ser. No. 11/555,647, filed Nov. 1, 2006 and entitled PROCESS AND APPARATUS FOR FEEDING

CEMENTITIOUS SLURRY FOR FIBER-REINFORCED STRUCTURAL CEMENT PANELS;

U.S. application Ser. No. 11/555,655, filed on Nov. 1, 2006, entitled METHOD FOR WET MIXING CEMENTITIOUS SLURRY FOR FIBER-REINFORCED STRUCTURAL CEMENT PANELS;

U.S. application Ser. No. 11/555,661, entitled PANEL SMOOTHING PROCESS AND APPARATUS FOR FORMING A SMOOTH CONTINUOUS SURFACE ON FIBER-REINFORCED STRUCTURAL CEMENT PANELS, filed Nov. 1, 2006;

U.S. application Ser. No. 11/555,665, filed Nov. 1, 2006, entitled WET SLURRY THICKNESS GAUGE AND METHOD FOR USE OF SAME;

U.S. application Ser. No. 11/591,793, filed Nov. 1, 2006, and entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT; and U.S. application Ser. No. 11/591,957, entitled EMBEDMENT ROLL DEVICE, filed Nov. 1, 2006;

all herein incorporated by reference in their entirety.

Embedment Device of the Present Invention

Referring now to FIG. 1, a structural panel production line is fragmentarily shown and is generally designated 10. The production line 10 includes a support frame or forming table 12 which supports a moving carrier 14, such as a rubber-like conveyor belt, a web of Kraft paper, release paper, and/or other webs of support material designed for supporting a slurry prior to setting, as is well known in the art. The carrier 14 is moved along the support frame 12 by a combination of motors, pulleys, belts or chains and rollers (none shown) which are also well known in the art. Also, while the present invention is intended for use in producing structural cement panels, it is contemplated that it may find application in any situation in which bulk fibers are to be mixed into a settable slurry for board or panel production.

The fiber embedment device 86 of the invention can be either one of two embodiments, namely an embedment device employing a wire grid 150 or an embedment device employing a honeycomb or grid cell 150A fiber embedment device with thin walls projecting perpendicularly from the grid plane. The distinctive features of these two versions of the proposed fiber embedment device are described below.

Figure 1A:
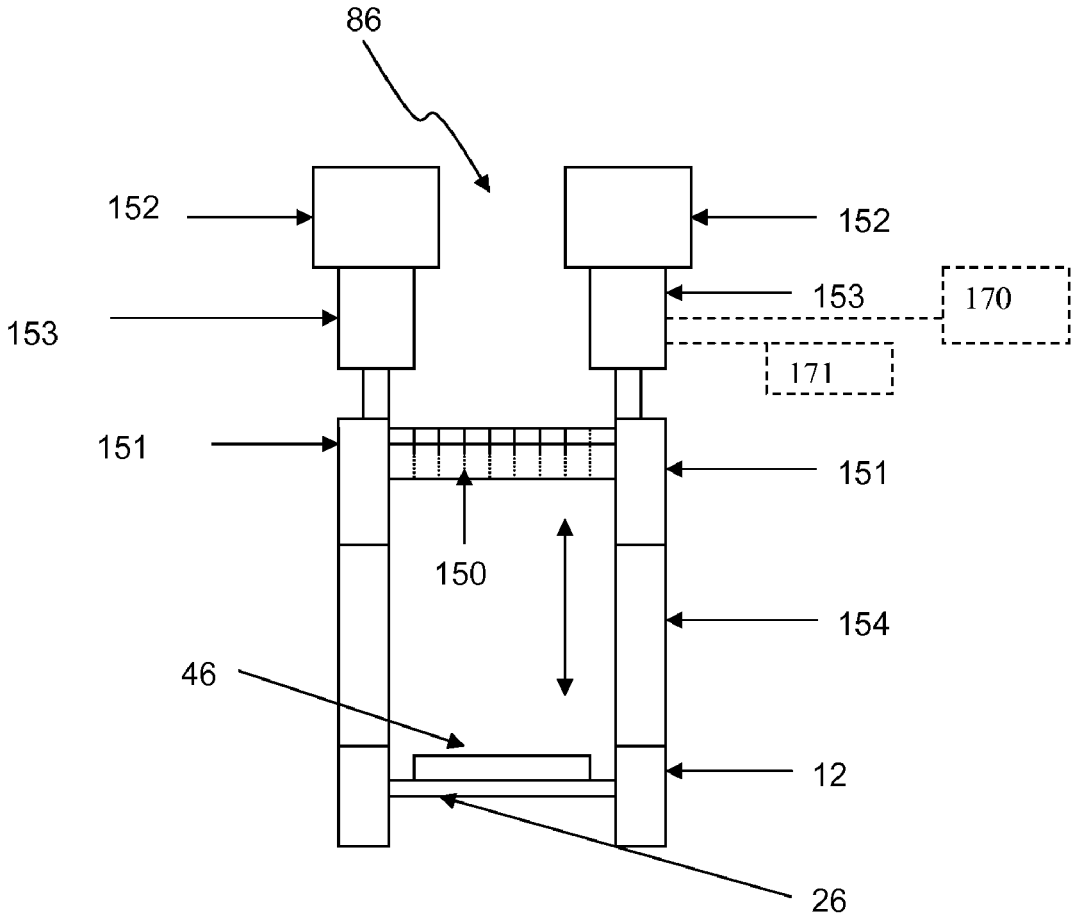
FIG. 1A is a front view of an embodiment of the embedment device of this invention viewed over the conveyor belt of the board production line of FIG. 1.

The wire grid is the first version of the proposed fiber embedment device that has been found to be very effective in embedding a layer of fiber network into a pre-deposited slurry layer. The wire grid is essentially an assemblage of small diameter metal/stainless steel wires interwoven and/or welded to form of a grid network. FIG. 2 shows a photograph of the wire grid embodiment of embedment device 86. The grid opening can either be square or of any other shape, depending upon the manner in which the grid wires are interwoven and/or welded. Reciprocating vertical motion of the wire grid, typically through use of a vertical mounted piston device such as that shown in FIG. 1A, is used to embed a distinct layer of fiber network into a pre-deposited distinct slurry layer.

The wire grid fiber embedment device is characterized by a structure that is open and permeable. The presence of the grid openings and the grid opening size play an important role and are critical to the effectiveness of such a fiber embedment device. The importance of the grid openings is discussed below:

The presence of the grid openings in this type of fiber embedment device serves an important function. During the reciprocating downward motion of the embedment device 86, the wire grid attempts to push the layer of fiber network into the slurry layer. In this scenario, the extent of success of the fiber embedment operation hinges on the ooze-out efficiency of the slurry through the fiber layer and through the fiber embedment device. The presence of the gird openings in the embedment device allows the slurry to ooze-out and in turn permits the fiber layer network to move into the slurry layer.

Figure 6:
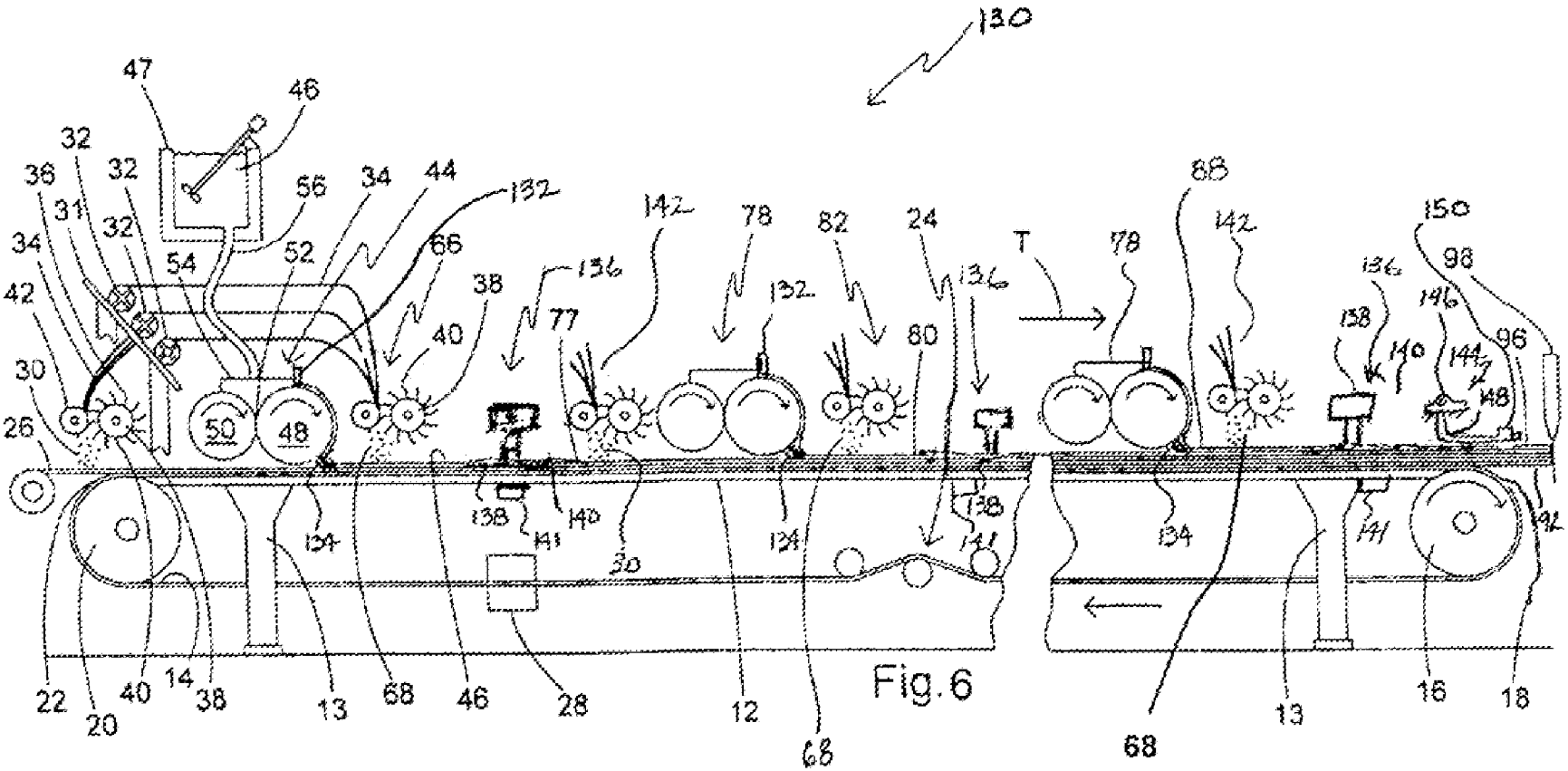
FIG. 6 is another embodiment of a structural cementitious panel production line.

The present embedment device, generally designated 86 in FIGS. 1 and 136 in FIG. 6, is disposed on the support frame 12 to be just "downstream" or after the point at which the fibers 18 are deposited upon the slurry web 16. As shown in FIG. 1A, embedment device 86 includes a wire grid 150 which is mounted on side wall supports 151 which are mounted on slide able support arms 154 to the side wall frames 12 of the conveyor belt 26. The piston arms 153 are mounted on top of each of the grid cell side walls 151 and are moved up and down by means of electrical motors 152. As the pistons 153 move up and down in a reciprocating motion. The wire grid 150 is embedded into the slurry 46 as the slurry travels beneath the wire grid 150 on the web 26. The piston can be run by a separate electric motor or can operated by optional pneumatic controller 170 or by optional hydraulic line 171 in FIG. 1A. The piston 153 can also be operated manually. The preferred form of operation of the piston arms would be to be driven by a separate electric motor as shown in FIG. 1A than can be control the rpm of the reciprocating arm to the line speed of the conveyor belt. Generally, the more repeated reciprocating motions of the piston arm of the embedment device into the fiber and cementitious slurry, the more effective mixing of the fiber and slurry and the embedment of the fiber into the slurry.

A grid cell structure embodiment (not shown in FIG. 1) of the embedment device of the invention can be substituted for the wire grid 150A in the embodiment shown in FIG. 1A with little or no changes being required in the structure.

Figure 1B:
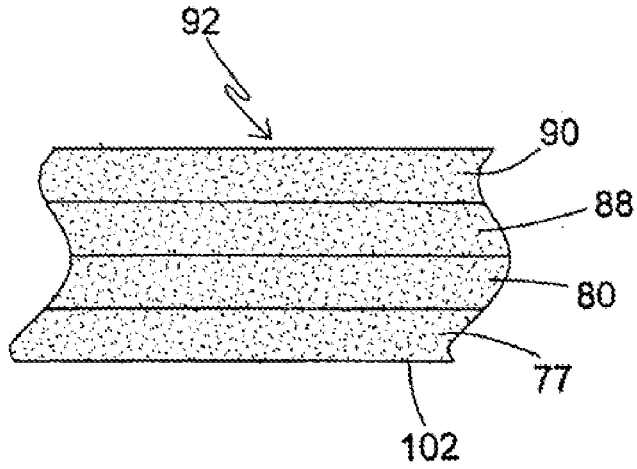
FIG. 1B is a side view of the slurry board panel produced in the production line of FIG. 1.
Figure 1C:
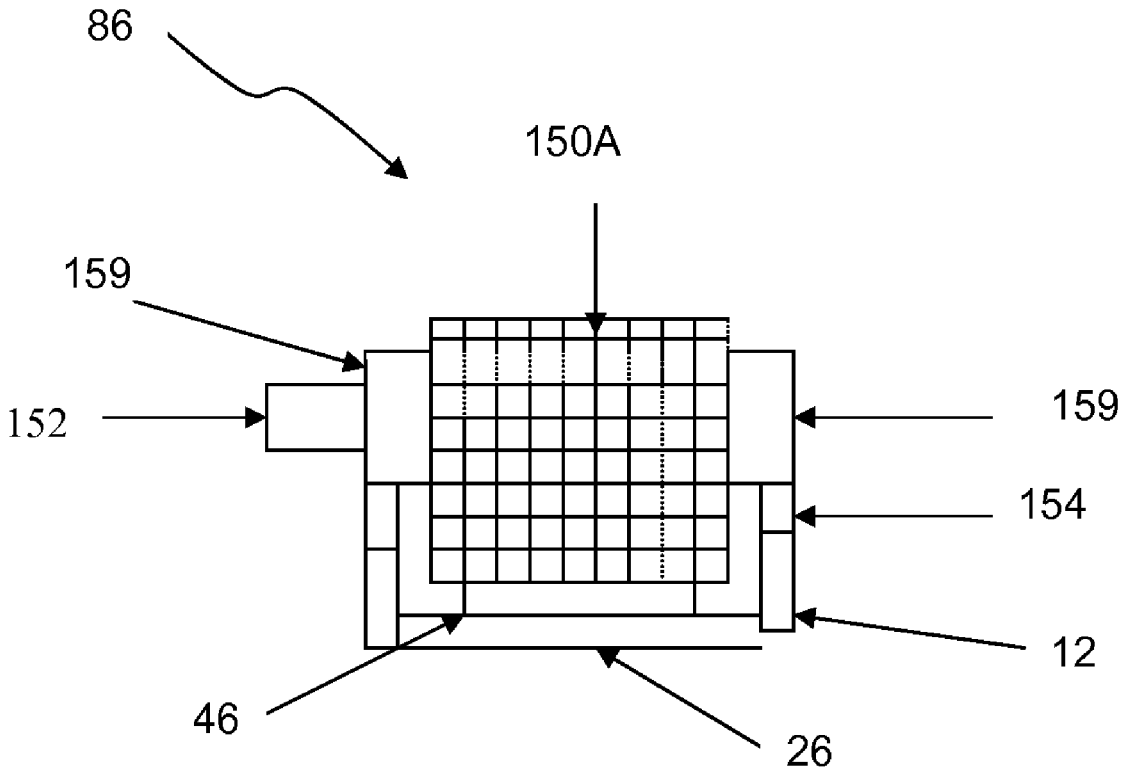
FIG. 1C is a front view of another embodiment of the grid cell embedment device of this invention mounted on the exterior surface of a wheel that rotates over the conveyor belt of the board production line.

An alternative embodiment for use of a grid cell 150 is shown in FIG. 1C in which the grid cells are mounted on the exterior surface of a wheel having a rotating central axis 159 which is rotated by side mounted electric motor 152. The wheel is mounted above the traveling conveyor 26 carrying the web of slurry 46 transverse of the direction of travel of the slurry 46 and in direct contact with the surface of the slurry and fiber. The wheel and grid cells 150A are attached to the side walls of the frame 12 by side arms 154 so that it rotates about a central support 159 and is rotated, for example, by a side mounted electric motor 152 so that is rotated at about the same speed as the slurry panel 46 moves on conveyor 26 as the grid cell are brought into contact with the surface of the panel 46.

Figure 1D:
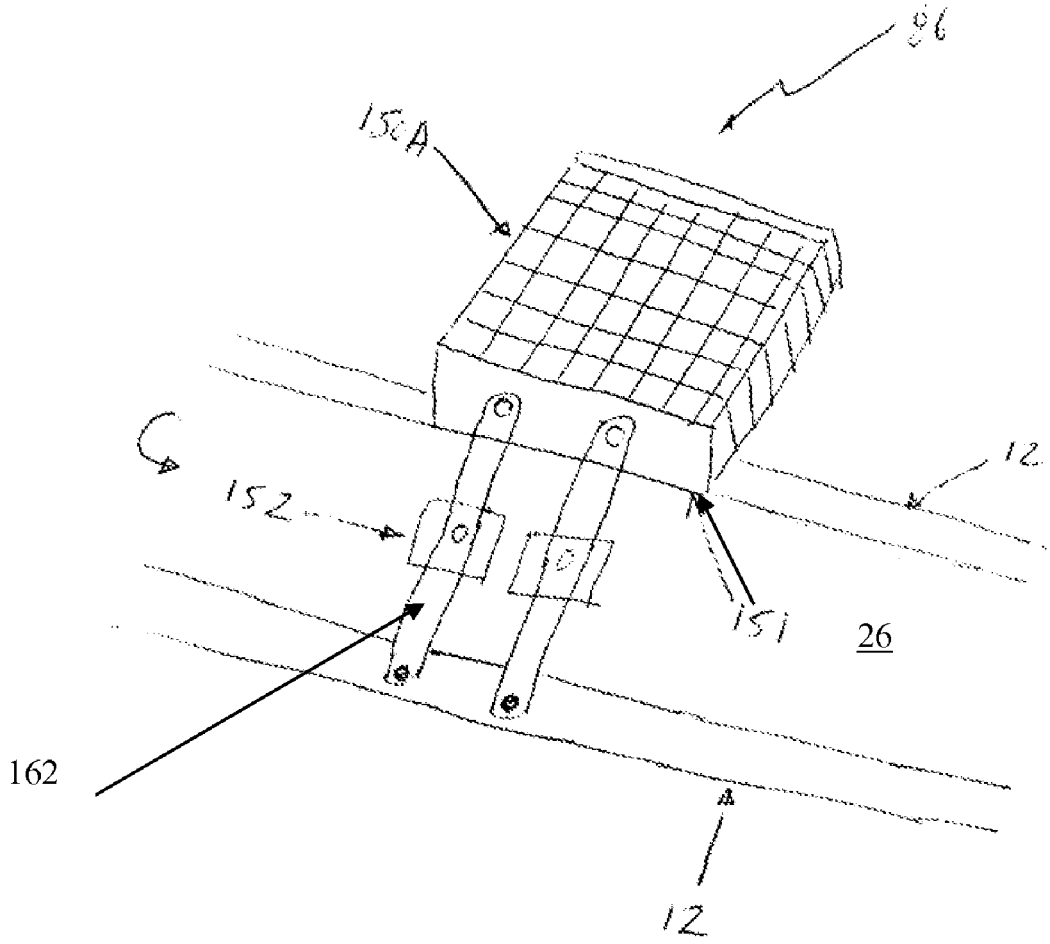

Another embodiment of a grid cell embedment is shown in FIG. 1D in which the grid cell 150A with side walls 151 is rotated mounted to the conveyor walls 12 by rotating arms 160 that are rotated in a counter clock wise direction about a central axis that is rotated by individual electric motors 152 over the slurry panel 46 on conveyor 26 by four rotating arms 161 that are driven in a crank and slider motion by the rotating arms 161.

In pilot plant operations, it has been found that 2-3 repeated applications of the wire grid or the grid cell embodiments of the instant embedment device into the slurry will give embedment of the fiberglass fibers equal to conventional sheep foot rollers or dual rollers used in above referenced SCP panel production processes shown in FIGS. 1 and 6.

While the relative dimensions of the grid openings may vary to suit the application, in the preferred embodiment, the stainless steel wires are 0.635 cm. (¼") thick and are spaced 0.8 cm. (5/16 in.) apart. This close tolerance makes it difficult for particles of the settable slurry 16 to become caught between the wires or walls of the grid structure and set prematurely. Also, since the grid is constantly moving up and down during SCP panel production, any slurry which is caught between the wire grid is quickly ejected, and has no chance to set in a way which would impair the embedment operation. It is also preferred that the peripheries of the grid are perpendicular to the plane of the slurry layer top surface, but it is also contemplated that tapered or otherwise angled edges could be provided and still achieve satisfactory fiber embedment.

The self-cleaning property of the present embedment device 20 is further enhanced by the materials used for the construction of the grid. In the preferred embodiment, these components are made of stainless steel which has been polished to obtain a relatively smooth surface. Also, stainless steel is preferred for its durability and corrosion resistance, however other durable, corrosion resistant and non-stick materials are contemplated, including Plexiglas material or other engineered plastic materials.

Further, the height of the wire grid relative to the moving web 14 is preferably adjustable to promote embedment of the fibers 18 into the slurry 16. It is preferred that the wire grid does not contact the carrier web 14, but extend sufficiently into the slurry 16 to promote embedment of the fibers 18 into the slurry. The specific height of the shafts 22, 24 above the carrier web 14 may vary to suit the application, and will be influenced, among other things, by the diameter of the main disks 32, the viscosity of the slurry, the thickness of the slurry layer 16 and the desired degree of embedment of the fibers 18

The size of the grid opening is an important feature of this type of fiber embedment device. It is critical to place an upper and a lower limit on the largest grid opening size. The upper limit on the largest opening size in the wire grid is kept equal to the length of shortest discrete fiber being used to reinforce the panel. An upper limit on the largest grid opening size ensures that the layer of fiber network gets pushed into the slurry layer cleanly without the occurrence of clogging and fiber jamming in the fiber embedment device. On the other hand, a lower limit on the largest grid opening size ensures that sufficient open area is available in the embedment device to obtain good slurry ooze-out efficiency.

In typical embodiments of the wire grid fiber embedment device, the grid opening size is at least 0.635 cm. (0.25 in.) but does not exceed the length of the shortest fiber used for reinforcement of the panel. More commonly, the grid opening is designed to less than about one half of the length of the shortest fiber used. The diameter of the grid wire is about 0.076 to 0.508 cm. (0.03 to 0.20 in.) and more commonly about 0.152 to 0.254 cm. (0.06 to 0.10 in).

The grid cell is another version of the proposed fiber embedment device. The grid cell is essentially a hollow, celled structure with thin, stiff walls made of metal e.g. stainless steel, rigid plastic, fiber reinforced plastic or any other material with a non-stick surface, such as a TEFLON® coating. FIG. 3 shows an example of such an embedment device. The grid cell opening can either be square or of any other shape. The fiber embedment mechanism of the honeycomb is conceptually same as that of the wire grid described previously. Reciprocating vertical motion of the grid cell is used to embed a distinct layer of fiber network into a pre-deposited distinct slurry layer.

The grid cell fiber embedment device is characterized by a cell structure that is open and permeable. The presence of cell openings and the cell opening size play an important role and are critical to the effectiveness of such a fiber embedment device. The importance of the cell opening is discussed below:

The presence of the cell opening in this type of fiber embedment device serves an important function. During the reciprocating downward motion of the embedment device, the honeycomb walls attempt to push the layer of fiber network into the slurry layer. In this scenario, the extent of success of the fiber embedment operation hinges on the ooze-out efficiency of the slurry through the fiber layer network and through the fiber embedment device. The presence of cell openings in the embedment device allows the slurry to ooze-out, and thereby permits the fiber layer network to move into the slurry layer.

The size of the grid cell opening is yet another important feature of this type of fiber embedment device. It is critical to place an upper and a lower limit on the largest cell opening size. The upper limit on the largest cell opening size is kept equal to the length of shortest discrete fiber being used to reinforce the panel. An upper limit on the largest cell opening size ensures that the layer of fiber network gets pushed into the slurry layer cleanly without the occurrence of clogging and fiber jamming in the fiber embedment device. On the other hand, a lower limit on the largest cell opening size ensures that sufficient open area is available to obtain good slurry ooze-out efficiency and hence good fiber embedment.

The preferred forms of the grid cell fiber embedment device are as follows:

Cell Opening Size

Preferred grid cell opening size ranges from 0.635 cm (1/4 in.) to the length of the shortest fiber used as reinforcement, $L_{f,\ and}$ and more typically, ranges up to one half of the length of the shortest fiber used.

Thickness of Cell Wall

The thickness of cell wall is about 0.076 to 0.508 cm. (0.03 to 0.20 in.) and more commonly about 0.152 to 0.254 cm. (0.06 to 0.10 in).

While other sequences are contemplated depending on the application, in the present invention, a layer of slurry 16 is deposited upon the moving carrier web 14 to form a uniform slurry web. While a variety of settable slurries are contemplated, the present embedment device is particularly designed for use in producing structural cement panels. As such, the slurry is preferably made up of varying amounts of Portland cement, gypsum, aggregate, water, accelerators, plasticizers, foaming agents, fillers and/or other ingredients well known in the art. The relative amounts of these ingredients, including the elimination of some of the above or the addition of others, may vary to suit the application. A supply of chopped fibers 18, which in the preferred embodiment are chopped fiberglass fibers, are dropped or sprinkled upon the moving slurry web 16.

Experimental Results:

An experimental evaluation of the effectiveness of the proposed fiber embedment device was conducted. This objective was achieved by manufacturing panels on the XY-Machine by building up multiple distinct fiber and slurry layers to produce panels of design thickness. A wire grid was used as the fiber embedment device. The performance of the proposed fiber embedment device was compared with that of the sheep foot roller method of fiber embedment. This comparison was made in light of the fact that the sheep foot roller method of fiber embedment is an industry standard for producing high-strength, glass fiber reinforced cement panels. Further details of the experimental evaluation are as follows:

Fiber Embedment Device

A wire grid made of stainless steel wire was used as the fiber embedment device. A photograph of this device is shown is FIG. 2. The details of this fiber embedment device are as follows:

Diameter of the grid wire—1/16"
Shape of the grid opening—Square
Size of the grid opening—3/8"

Panels Investigated

The first three panels (i.e., Panels 1, 2 and 3) were cast be aggregating distinct layers of slurry and fiber to produce panels of design thickness. Six distinct slurry layers and six distinct fiber layers were used to produce the full thickness panel. Manufacture of each panel was split into two halves. The first half of each panel served as the control panel that was manufactured using the sheep foot roller as the fiber embedment device. The second half of each panel was produced using the wire grid as the fiber embedment device. The fiber volume fraction in the Panels 1, 2 and 3 were 2%, 3% and 4%, respectively. The design thickness of the panels was half inch.

The last three panels (i.e., Panels 4, 5 and 6) were the control panels. These panels were cast using the conventional spray up process in which the slurry and fiber layers were simultaneously sprayed on to the mold. Six layers were sprayed to produce the full thickness panel. Each sprayed layer was compacted using the sheep foot roller to achieve good embedment of the fibers into the slurry. The fiber volume fraction in the Panels 4, 5 and 6 were 2%, 3% and 4%, respectively. The design thickness of the panels was half inch.

Method of Manufacturing

The following steps were involved in the production of Panels 1, 2 and 3:

1. A casting mold was split into two equal parts. The first half of the mold was for casting the panel using the sheep foot roller fiber embedment method. The second half of the mold was for casting the panel using the two-wire grid method of fiber embedment. Both halves were cast simultaneously to minimize the variability associated with materials and manufacturing methods.

2. A distinct layer of slurry of design thickness was laid on top of the mold.

3. A layer of chopped fibers was laid on top of the pre-laid slurry layer.

4. Embedment of the layer of fiber network into the slurry layer was accomplished using the sheep foot roller in the first half of the mold and using the wire grid in the second half of the mold.

5. Steps 2 to 4 were repeated for the remaining five layers to achieve the design panel thickness.

Formulation

Standard SCP formulation was used to manufacture all panels. The reactive powder used was a blend of ASTM Type III Portland cement, alpha hemihydrate, silica fume and lime. Hollow ceramic spheres were used as lightweight fillers to reduce the material/panel density. Polynapthalene sulfonate type superplasticizer was used as the water-reducing admixture. Alkali-resistant glass fibers chopped from a continuous roving with designation NEG ARG-103 (procured from Nippon Electric Glass Company, North America) were used as the reinforcing fibers. For this continuous roving, the roving tex was 2500 and the strand tex was 80. Each fiber strand was an assemblage of 200 alkali-resistant glass fiber monofilaments. The length of the fibers used was 40 mm.

The following formulation was used for manufacturing the fiber reinforced cementitious panels:

| | |
|---|---|
| Type III Portland cement | 12.7% |
| Alpha Hemihydrate | 25.5% |
| Silica Fume | 5.20% |
| Hydrated Lime | 0.40% |
| Hollow Ceramic Microspheres | 28.9% |
| Polynapthalene Sulfonate Superplasticizer | 2.60% |
| Water | 24.6% |
| Potassium Tartrate | 0.031% |

Experimental Results

The wire grid fiber embedment device in action and the corresponding results obtained are shown in FIGS. 2, 4 and 5. The flexural strength results for the panels tested are tabulated in Table 2 and are plotted in FIGS. 7 and 8. A discussion on the important results is as follows:

The photographs shown in FIGS. 4 and 5 demonstrate the effectiveness of the wire grid in embedding a layer of fiber network into a slurry layer. The photograph in FIG. 4 shows slurry oozing out profusely through the layer of fiber network and through the wire grid. The photograph in FIG. 5 shows the surface of the panel subsequent to the application of the wire grid fiber embedment device. In this photograph, it can be clearly seen that the layer of fiber network is effectively embedded in the slurry layer.

Photograph in FIG. 2 shows the wire grid embedment fiber embedment device subsequent to its application. It can be seen that the embedment device stays clean after its use.

Table 1 and FIGS. 7-8, show the influence of fiber embedment method on flexural strength when the panels are manufactured using distinct slurry and fiber layers. The following two manufacturing approaches are compared:

Approach 1: Distinct layers of slurry and fibers+Sheep foot roller fiber embedment method Approach 2: Distinct layers of slurry and fibers+The wire grid fiber embedment method The results shown in FIGS. 7 and 8 demonstrate that the flexural strengths obtained with the wire grid method of fiber embedment compare well with those obtained with use of the state-of-the-art, sheep-foot roller fiber embedment method.

Table 1 and FIGS. 7-8 show the influence of fiber embedment method on flexural strength for the panels manufactured using the following two approaches:

Approach 1: Simultaneous spray of slurry and fibers+Sheep foot roller fiber embedment method Approach 2: Distinct layers of slurry and fibers+The wire grid fiber embedment method Again, the flexural strength results shown in Table 1 and FIG. 7-8 demonstrate that both of the aforementioned approaches of manufacturing fiber-reinforced cement panels yield comparable results. Thus, it can be seen that the wire grid method of fiber embedment is at least equivalent to the sheep foot roller method of fiber embedment, and in some instances better in achieving a higher modulus of rupture in the resulting panels than that obtained with the sheep foot roller embedment method. The importance of this conclusion is significant in the light of the fact that the manufacturing method involving simultaneous spray of slurry and fibers and sheep foot roller method of fiber embedment (i.e., approach 1) is the industry standard for producing high-strength, glass fiber reinforced cement panels.

Since the fibers 18 have been immediately previously deposited upon an upper surface 50 of the slurry 16, a certain percentage of the fibers will become mixed into the slurry through, the carrier web or belt 14 is also moving in a direction of travel from the first downward motion of the grid. In this manner, a churning dynamic movement is also created which will enhance the embedment of the fibers 18.

A fiber embedment device must effectively embed a distinct layer of fiber network into a distinct layer of slurry for producing fiber reinforced cementitious panels. The fiber embedment device of this invention is particularly useful in the manufacturing processes where it is desired to produce panels by building up several distinct layers of slurry and fibers. Such a manufacturing approach is currently being adopted on an existing SCP production line. The experimental results obtained in the production of fiber reinforced SCP panels on a pilot production line demonstrate that the fiber embedment efficiency of the proposed method of fiber method is equivalent to that of the industry standard, sheep foot roller method of fiber embedment.

Two versions of fiber embedment device are proposed: a wire grid and a grid cell device. The proposed fiber embedment device is characterized by a structure that is open and permeable. The presence of openings and the opening size have an important function and are critical to the effectiveness of the proposed fiber embedment device.

The embedment of a layer of fiber network into a predeposited slurry layer is accomplished as a result of the reciprocating vertical motion of the proposed fiber embedment device. During its downward reciprocating motion, the proposed fiber embedment device pushes the layer of fiber network into the slurry layer. The presence of openings in the proposed fiber embedment device serves an important function by allowing the slurry to ooze-out and in turn permitting the fiber layer network to move into the slurry layer.

An upper and a lower limit are placed on the largest opening size in the proposed fiber embedment device. The upper limit on the largest opening size is equal to the length of shortest discrete fiber being used to reinforce the panel. Placing an upper limit on the largest opening size ensures that the layer of fiber network gets pushed into the slurry layer cleanly without the occurrence of clogging and fiber jamming in the fiber embedment device. On the other hand, a lower limit on the largest opening size ensures that enough open area is available in the embedment device to obtain good slurry ooze-out efficiency.

The preferred embodiments of the proposed fiber embedment device are as follows:

The Wire Grid Fiber Embedment Device

Grid Opening Size

Preferred grid opening size 0.635 cm (¼ in.) to $L_f$

Most preferred grid opening size 0.635 cm. (¼ in.) to $L_f/2$ where, $L_f$ is the length of the shortest fiber used as reinforcement In a typical embodiment, the wire grid or grid cell structure is designed to penetrate the first layer of fiber and slurry to the slurry carrier on the conveyor belt to ensure mixing of the fiber from both the bottom and top layers. With the addition of additional layers of fiber and slurry, the subsequent embedment stations are design to have the embedment device penetrate the upper most layers to the interface of the top layer with the layer of slurry and fiber below. This will ensure that a bond between the layers is achieved with the fiber layer mixing between the two layers at the interface.

Thus, the present embedment device provides a mechanism for incorporating or embedding chopped fiberglass fibers into a moving slurry layer. An important feature of the present device is that the grid provides a sufficient kneading, massaging or churning action to the slurry in a way which minimizes the opportunity for slurry to clog, coat or become trapped in the device.

Applying Additional Layers

Once the fiber 68 has been embedded, a first layer 77 of the panel 92 is complete. In a preferred embodiment, the height or thickness of the first layer 77 is in the approximate range of 0.127 to 0.889 cm. (0.05 to 0.35 inches). This range has been found to provide the desired strength and rigidity when combined with like layers in a SCP panel. However other thicknesses are contemplated depending on the final intended use of the SCP panel.

To build a structural cementitious panel of desired thickness, additional layers are typically added. To that end, a second slurry feeder 78, which is substantially identical to the feeder 44, is provided in operational relationship to the moving carrier 14, and is disposed for deposition of an additional layer 80 of the slurry 46 upon the existing layer 77.

Next, an additional chopper 82, substantially identical to the choppers 36 and 66, is provided in operational relationship to the frame 12 to deposit a third layer of fibers 68 provided from a rack (not shown) constructed and disposed relative to the frame 12 in similar fashion to the rack 31. The fibers 68 are deposited upon the slurry layer 80 and are embedded using a second embedment device 86. Similar in construction and arrangement to the embedment device 70, the second embedment device 86 is mounted slightly higher relative to the moving carrier web 14 so that the first layer 77 is not disturbed. In this manner, the second layer 80 of slurry and embedded fibers is created.

Referring now to FIGS. 1 and 1B, with each successive layer of settable slurry and fibers, an additional slurry feeder station 78 followed by a fiber chopper 82 and an embedment device 86 is provided on the production line 10. In a preferred embodiment, four total layers 77, 80, 88, 90 are provided to form the SCP panel 92.

An important feature of the present invention is that the panel 92 has multiple layers 77, 80, 88, 90 which upon setting, form an integral, fiber-reinforced mass. Provided that the presence and placement of fibers in each layer are controlled by and maintained within certain desired parameters as is disclosed and described herein, it will be virtually impossible to delaminate the panel 92 produced by the present process.

Forming, Smoothing and Cutting

Upon the disposition of the four layers of fiber-embedded settable slurry as described above, a forming device may provided to the frame 12 to shape an upper surface 96 of the panel 92.

However, forming devices which scrape away excess thickness of SCP panel material are not desired. For example, forming devices such as spring-loaded or vibrating plates or vibrating leveling screeds designed to conform the panel to suit desired dimensional characteristics are not used with SCP material since they scrape away excess thickness of SCP panel material are not employed. Such devices would not effectively scrape away or flatten the panel surface. They would cause the fiberglass to begin to roll up and mar the surface of the panel instead of flattening and smoothing it.

In particular, rather than spring-loaded devices and vibrating leveling screeds, the production line 10 may include a smoothing device, also termed a vibrating shroud, shown in FIG. 6 of U.S. application Ser. No. 11/555,661 filed Nov. 1, 2006 as 144 provided to the frame 12 to gently smooth an upper surface 96 of the panel 92. The smoothing device 144 includes a mounting stand 146, a flexible sheet 148 secured to the mounting stand, a stiffening member extending the width of the sheet 148 and a vibration generator (vibrator) 150 preferably located on the stiffening member to cause the sheet 148 to vibrate. The sheet 148 has a first upstanding wall provided with a U-shaped upper portion, a curved wall and a second upstanding wall. The vibrator 150 is powered by a pneumatic hose The curved panel of the smoothing device 144 has an upstream end pivotally attached to a support bar which in turn is attached to mount 146 on the production line 10. The curved panel 148C has a trailing downstream end which contacts the topmost layer of the SCP material passing underneath it. If desired the smoothing device 144 is provided with weights to assist in leveling the topmost layer of slurry. The smoothing device 144 may be provided after the last embedment station 86 or smoothing devices may be provided after each embedment station 70, 86.

The stiffening member functions not only to stiffen the smoothing sheet, but, by mounting the vibratory unit on this stiffening member, this distributes the vibration across the length of the device more evenly. For example, if we mount the vibratory unit directly to the smoothing sheet (say, in the center), without the stiffening member, the vibration from the vibratory unit would be highly localized at the mounting point, with relatively little vibration out on the edges of the sheet. This is not to say that the vibratory unit cannot be mounted anywhere besides the stiffening member 150B, but it is a preferred location since a stiffening member is typically anyway and it does a good job of equally distributing the vibration.

By applying vibration to the slurry 46, the smoothing device 144 facilitates the distribution of the fibers 30, 68 throughout the panel 92, and provides a more uniform upper surface 96.

Additional details regarding the vibrating shroud 144 are disclosed by U.S. application Ser. No. 11/555,661, entitled PANEL SMOOTHING PROCESS AND APPARATUS FOR FORMING A SMOOTH CONTINUOUS SURFACE ON FIBER-REINFORCED STRUCTURAL CEMENT PANELS, filed Nov. 1, 2006 and incorporated herein by reference in its entirety.

Other forming devices are known in the art. however, the smoothing device 144 advantageously avoids disrupting or tearing portions of the SCP panel from carrier web 26. Forming devices that scrape away excess SCP material are not employed because they disrupt or tear the SCP material due to the fibrous nature of the panel product as it is being formed.

At this point, the layers of slurry have begun to set, and the respective panels 92 are separated from each other by a cutting device 98, which in a typical embodiment is a water jet cutter. Other cutting devices, including moving blades, are considered suitable for this operation, provided they can create suitably sharp edges in the present panel composition. The cutting device 98 is disposed relative to the line 10 and the frame 12 so that panels are produced having a desired length, which may be different from the representation shown in FIG. 1. Since the speed of the carrier web 14 is relatively slow, the cutting device 98 may be mounted to cut perpendicularly to the direction of travel of the web 14. With faster production speeds, such cutting devices are known to be mounted to the production line 10 on an angle to the direction of web travel. Upon cutting, the separated panels 92 are stacked for further handling, packaging, storage and/or shipment as is well known in the art.

The production line 10 includes sufficient fiber chopping stations 36, 66, 82, slurry feeder stations 44, 78 and embedment devices 70, 86 to produce at least four layers 77, 80, 88 and 90 (FIG. 1B). Additional layers may be created by repetition of stations as described above in relation to the production line 10.

Upon creation of the SCP panels 92, an underside 102 or bottom face of the panel may be smoother than the upper side or top face 96, even after being engaged by the forming device 94. In some cases, depending on the application of the panel 92, it may be preferable to have a smooth face and a relatively rough face. However, in other applications, it may be desirable to have a board in which both faces 96, 102 are smooth. The smooth texture is generated by the contact of the slurry with the smooth carrier 14 or the carrier web 26.

To obtain a SCP panel with both faces or sides smooth, both upper and lower faces 96, 102 may be formed against the carrier 14 or the release web 26 as disclosed by U.S. application Ser. No. 11/591,793, entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT, filed Nov. 1, 2006.

Another alternative (not shown) is to sand one or both faces or sides 96, 102.

Another feature of the present invention is that the resulting SCP panel 92 is constructed so that the fibers 30, 68 are uniformly distributed throughout the panel. This has been found to enable the production of relatively stronger panels with relatively less, more efficient use of fibers. The volume fraction of fibers relative to the volume of slurry in each layer preferably constitutes approximately in the range of 1% to 5% by volume, preferably 1.5% to 3% by volume, of the slurry layers 77, 80, 88, 90. If desired, the outer layers 77, 90 may have a higher volume fraction that either or both of inner layers 80, 88.

Alternative Panel Production Line

The incorporation of a volume fraction of loose fibers distributed throughout the slurry 46 is an important factor in obtaining desired panel strength. Thus, improved efficiency in incorporating such fibers is desirable. It is believed the system depicted in FIG. 1 in some cases requires excessive numbers of slurry layers to obtain an SCP panel having sufficient fiber volume fraction.

Accordingly, an alternate SCP panel production line or system is illustrated in FIG. 6 and is generally designated 130 for producing high-performance, fiber reinforced SCP panels incorporating a relatively high volume of fibers per slurry layer. In many cases, increased levels of fibers per panel are obtained using this system. While the system of FIG. 1 discloses depositing a single discrete layer of fibers into each subsequent discrete layer of slurry deposited after the initial layer, the production line 130 includes a method of building up multiple discrete reinforcing fiber layers in each discrete slurry layer to obtain the desired panel thickness. Most preferably, the disclosed system embeds at least two discrete layers of reinforcing fibers, in a single operation, into an individual discrete layer of slurry. The discrete reinforcing fibers are embedded into the discrete layer of slurry using a suitable fiber embedment device.

More specifically, in FIG. 6 components used in the system 130 and shared with the system 10 of FIG. 1 are designated with identical reference numbers, and the above description of those components is considered applicable here. Furthermore, it is contemplated that the apparatus described in relation to FIG. 6 may be combined with that of FIG. 1 in a retrofit manner or be a new construction.

It is also contemplated that the system 130 of FIG. 6 may be provided with the upper deck 106 of U.S. application Ser. No. 11/591,793, entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT, Nov. 1, 2006.

In the alternate system 130, SCP panel production is initiated by depositing a first layer of loose, chopped fibers 30 upon the web 26. Next, the slurry feed station, or the slurry feeder 44 receives a supply of slurry 46 from the remote mixer 47.

The mixer 47 and slurry 46 in this production line would be the same as that used in the production line 10 of FIG. 1.

Also, the slurry feeder 44 is basically the same, including the main metering roll, 48 and the back up roll 50 to form the nip 52 and having the sidewalls (not shown). Suitable layer thicknesses range from about 0.05 inch to 0.35 inch (0.13 to 0.9 cm). For instance, for manufacturing a nominal ¾ inch (1.9 cm) thick structural panel, four layers are preferred with an especially preferred slurry layer thickness less than approximately 0.25 inch (0.64 cm) in the preferred structural panel produced by the present process.

Referring to FIGS. 1 and 6, the slurry 46 is delivered to the feeder 44 through the hose 56 located in the laterally reciprocating, cable driven, fluid powered dispenser 58. Slurry flowing from the hose 56 is thus poured into the feeder 44 in a laterally reciprocating motion to fill a reservoir defined by the rolls 48, 50 and the sidewalls. Rotation of the metering roll 48 thus draws a layer of the slurry 46 from the reservoir.

The system 130 is preferably provided with the above-described vibrating gate 132 which meters slurry onto the deposition or metering roll 48. By vibrating, the gate 132 prevents significant buildup in the corners of the headbox 44 and provides a more uniform and thicker layer of slurry than was provided without vibration.

Even with the addition of the vibrating gate 132, the main metering roll 48 and the backup roll 50 are rotatably driven in the same direction of travel "T" as the direction of movement of the carrier 14 and the carrier web 26 which minimizes the opportunities for premature setting of slurry 46 on the respective moving outer surfaces.

As the slurry 46 on the outer surface 62 of the main metering roll 48 moves toward the carrier web 26, the above-described spring biased doctor blade 134 is provided which separates the slurry 46 from the main metering roll 48 and deposits the slurry 46 onto the moving web 26. The doctor blade 134 provides the slurry 46 with a direct path down to within about 1.5 inches of the carrier web 26, allowing an unbroken curtain of slurry to be continuously deposited onto the web or forming line, which is important to producing homogeneous panels.

Additional details of the gate 132 and the doctor blade 134 are provided in commonly assigned copending U.S. application Ser. No. 11/555,647, filed Nov. 1, 2006, and entitled PROCESS AND APPARATUS FOR FEEDING CEMENTITIOUS SLURRY FOR FIBER-REINFORCED STRUCTURAL CEMENT PANELS, which is incorporated by reference.

A second chopper station or apparatus 66, preferably identical to the chopper 36, is disposed downstream of the feeder 44 to deposit a second layer of fibers 68 upon the slurry 46. The chopper apparatus 66 may be fed cords 34 from the same rack 31 that feeds the chopper 36. However, it is contemplated that separate racks 31 could be supplied to each individual chopper.

Referring again to FIG. 6, next, the embedment device of this invention, generally designated 136, is disposed in operational relationship to the slurry 46 and the moving carrier 14 of the production line 130 to embed the first and second layers of fibers 30, 68 into the slurry 46. The embedment device 136 of this invention provides the same kneading action as the commercial sheep foot roller device found in co-pending, commonly assigned U.S. application Ser. No. 11/591,957, entitled EMBEDMENT ROLL DEVICE, filed on Nov. 1, 2006, which is incorporated by reference to embed or thoroughly mix the fibers 30, 68 within the slurry 46.

As seen in FIG. 6, to implement the present system 130 of multiple layers of fibers 30, 68 for each layer of slurry 46, additional chopping stations 142 are provided between the embedment device 136 and subsequent slurry feeder boxes 78, so that for each layer of slurry 46, fibers 30, 68 are deposited before and after deposition of the slurry. This has been found to enable the introduction of significantly more fibers into the slurry and accordingly increase the strength of the resulting SCP panel. In the preferred production line four total layers of combined slurry and fiber are provided to form the SCP panel 92.

Upon the disposition of the four layers of fiber-embedded settable slurry as described above, a forming device such as the smoothing device, or vibrating shroud, 144 is preferably provided to the frame 12 to shape or smooth an upper surface 96 of the panel 92. By applying vibration to the slurry 46, the smoothing device 144 facilitates the distribution of the fibers 30, 68 throughout the panel 92, and provides a more uniform upper surface 96. The smoothing device 144 includes a mounting stand, a flexible sheet 148 secured to the mounting stand, a stiffening member extending the width of the sheet 148 and a vibration generator preferably located on the stiffening member (not shown) to cause the sheet to vibrate.

As mentioned above, an important feature of the present invention is that the panel 92 has multiple layers 77, 80, 88, 90 which upon setting, form an integral, fiber-reinforced mass. Provided that the presence and placement of fibers in each layer are controlled by and maintained within certain desired parameters as is disclosed and described below, it will be virtually impossible to delaminate the panel 92 produced by the present process.

Utilizing two discrete layers of reinforcing fibers with each individual discrete slurry layer provides the following benefits. First, splitting the total amount of fibers to be incorporated in the slurry layer into two or more discrete fiber layers reduces the respective amount of fibers in each discrete fiber layer. Reduction in the amount of fibers in the individual discrete fiber layer enhances efficiency of embedment of fibers into the slurry layer. Improved fiber embedment efficiency in turn results in superior interfacial bond and mechanical interaction between the fibers and the cementitious matrix.

Next, a greater amount of reinforcing fibers can be incorporated into each slurry layer by utilizing multiple discrete layers of reinforcing fibers. This is due to the finding that the ease of embedment of the fibers into the slurry layer has been found to depend upon the total surface area of the fibers in the discrete fiber layer. Embedment of the fibers in the slurry layer becomes increasingly difficult as the amount of fibers in the discrete fiber layer increases, causing an increase in the surface area of the fibers to be embedded in the slurry layer. It has been found that when the total surface area of the fibers in the discrete fiber layer reaches a critical value, embedment of the fibers into the slurry layers becomes almost impossible. This imposes an upper limit on the amount of fibers that can successfully be incorporated in the discrete layer of slurry. For a given total amount of fibers to be incorporated in the discrete slurry layer, use of multiple discrete fiber layers reduces the total surface area of the fibers in each discrete fiber layer. This reduction in the fiber surface area (brought about by the use of multiple discrete fiber layers) in turn provides an opportunity to increase the total amount of fibers that can successfully be embedded into the discrete layer of slurry.

In addition, the use of multiple discrete fiber layers allows tremendous flexibility with respect to the distribution of fibers through the panel thickness. The amount of fibers in the individual discrete fiber layers may be varied to achieve desired objectives. The resulting creation of a "sandwich" construction is greatly facilitated with the presence of a larger number of discrete fiber layers. Panel configurations with fiber layers having higher amount of fibers near the panel skins and lower amount of fibers in the fiber layers near the panel core are particularly preferred from both product strength and cost optimization perspectives.

In quantitative terms, the influence of the number of fiber and slurry layers, the volume fraction of fibers in the panel, and the thickness of each slurry layer, and fiber strand diameter on fiber embedment efficiency has been investigated and established as part of the present system 130. A mathematical treatment for the concept of projected fiber surface area fraction for the case involving two discrete fiber layers and one discrete slurry layer is introduced and derived below. It has been found that it is virtually impossible to embed fibers in the slurry layer if the projected fiber surface area fraction of the discrete fiber layer exceeds a value of 1.0. Although the fibers may be embedded when the projected fiber surface area fraction falls below 1.0, the best results are obtained when the projected fiber surface area fraction is less than 0.65. When the projected fiber surface area fraction ranges between 0.65 and 1.00, the efficiency and ease of fiber embedment varies with best fiber embedment at 0.65 and worst at 1.00. Another way of considering this fraction is that approximately 65% of a surface of the slurry is covered by fibers. This is further described in U.S. application Ser. No. 11/555,661 filed Nov. 1, 2006, incorporated herein by reference.

Let, $v_t$=Total volume of a fundamental fiber-slurry layer $v_{f,l}$=Total fiber volume/layer $v_{f1}$=Volume of fiber in discrete fiber layer 1 of a fundamental fiber-slurry layer $v_{f2}$=Volume of fiber in discrete fiber layer 2 of a fundamental fiber-slurry layer $v_{s,l}$=Volume of slurry in a fundamental fiber-slurry layer $V_{f,l}$=Total volume fraction of fibers in a fundamental fiber-slurry layer $d_f$=Diameter of individual fiber strand $l_f$=Length of individual fiber strand $t_l$=Total thickness of individual layer including slurry and fibers $t_{s,l}$=Slurry layer thickness in a fundamental fiber-slurry layer $X_f$=Ratio of layer 2 fiber volume to layer 1 fiber volume of a fundamental fiber-slurry layer $n_{f,l}$, $n_{f1,l}$, $n_{f2,l}$=Total number of fibers in a fiber layer $s_{f,l}^P$, $s_{f1,l}^P$, $s_{f2,l}^P$=Total projected surface area of fibers contained in a fiber layer $S_{f,l}^P$, $S_{f1,l}^P$, $S_{f2,l}^P$=Projected fiber surface area fraction for a fiber layer Projected fiber surface area fraction of fiber layer 1, $S_{f1,l}^P$ is defined as follows:

$$S_{f1,l}^P = \frac{\text{Projected surface area of all fibers in layer 1, } S_{f1,l}^P}{\text{Projected surface area of the slurry layer, } S_{s,l}^P} \tag{1}$$

The projected fiber surface area fraction of fiber layer 1, $S_{f1,l}^P$ can be derived as:

$$S_{f1,l}^P = \frac{4V_{f,l}t_l}{\pi(1+X_f)d_f} \tag{2}$$

Similarly, the projected fiber surface area fraction of fiber layer 2, $S_{f2,l}^P$ can be derived as:

$$S_{f2,l}^P = \frac{4X_f V_{f,l}t_l}{\pi(1+X_f)d_f} \tag{3}$$

Equations 2 and 3 depict dependence of the parameter projected fiber surface area fraction, $S_{f1,l}^P$ and $S_{f2,l}^P$ on several other variables in addition to the variable total fiber volume fraction, $V_{f,l}$. These variables are diameter of fiber strand, thickness of discrete slurry layer, and the amount (proportion) of fibers in the individual discrete fiber layers.

Experimental observations confirm that the embedment efficiency of a layer of fiber network laid over a cementitious slurry layer is a function of the parameter "projected fiber surface area fraction". It has been found that the smaller the projected fiber surface area fraction, the easier it is to embed the fiber layer into the slurry layer. The reason for good fiber embedment efficiency can be explained by the fact that the extent of open area or porosity in a layer of fiber network increases with decreases in the projected fiber surface area fraction. With more open area available, the slurry penetration through the layer of fiber network is augmented, which translates into enhanced fiber embedment efficiency.

Accordingly, to achieve good fiber embedment efficiency, the objective function becomes keeping the fiber surface area fraction below a certain critical value. It is noteworthy that by varying one or more variables appearing in the Equation 15, the projected fiber surface area fraction can be tailored to achieve good fiber embedment efficiency.

Different variables that affect the magnitude of projected fiber surface area fraction are identified and approaches have been suggested to tailor the magnitude of "projected fiber surface area fraction" to achieve good fiber embedment efficiency. These approaches involve varying one or more of the following variables to keep projected fiber surface area fraction below a critical threshold value: number of distinct fiber and slurry layers, thickness of distinct slurry layers and diameter of fiber strand.

Based on this fundamental work, the preferred magnitudes of the projected fiber surface area fraction $S_{f1,l}^P$ have been discovered to be as follows:

| | |
|---|---|
| Preferred projected fiber surface area fraction, $S_{f1,l}^P$ | <0.65 |
| Most preferred projected fiber surface area fraction, $S_{f1,l}^P$ | <0.45 |

For a design panel fiber volume fraction, $V_f$, for example a percentage fiber volume content in each slurry layer of 1-5%, achievement of the aforementioned preferred magnitudes of projected fiber surface area fraction can be made possible by tailoring one or more of the following variables—total number of distinct fiber layers, thickness of distinct slurry layers and fiber strand diameter. In particular, the desirable ranges for these variables that lead to the preferred magnitudes of projected fiber surface area fraction are as follows:

Thickness of Distinct Slurry Layers, $t_{s,l}$

| | |
|---|---|
| Preferred thickness of distinct slurry layers, $t_{s,l}$ | ≦0.35 inches |
| More Preferred thickness of distinct slurry layers, $t_{s,l}$ | ≦0.25 inches |
| Most preferred thickness of distinct slurry layers, $t_{s,l}$ | ≦0.15 inches |

Fiber Strand Diameter, $d_f$

| | |
|---|---|
| Preferred fiber strand diameter, $d_f$ | ≧30 tex |
| Most preferred fiber strand diameter, $d_f$ | ≧70 tex |

Referring now to FIG. 1B, a fragment of the SCP panel 92 made from fibers and a slurry. The cement portion of the slurry comprises 65 wt. % Calcium sulfate alpha hemihydrate, 22 wt. % Type III Portland cement, 12 wt. % Silica Fume, and 1 wt. % hydrated lime. The liquid portion of the slurry comprises 99.19 wt. % water and 0.81 wt. % ADVACAST superplasticizer by W.R. Grace and Co. The liquid cement weight ratio was 0.55 and the Aggregate (EXTENDOSPHERES SG microspheres):Cement weight ratio was 0.445.

The slurry was produced according to the present process, using the present system, and is shown to have four slurry layers, 77, 80, 88 and 90. This panel should be considered exemplary only in that a panel 92 produced under the present system may have one or more layers. By using the above mathematical relationships, the slurry layers 77, 80, 88 and 90 can have different fiber volume fractions. For example, skin or face layers 77, 90 have a designated fiber volume fraction $V_f$ of 5%, while inner layers 80, 88 have a designated $V_f$ of 2%. This provides a panel with enhanced outer strength, and an inner core with comparatively less strength, which may be desirable in certain applications, or to conserve fibers for cost reasons. It is contemplated that the fiber volume fraction $V_f$ may vary among the layers 77, 80, 88, 90 to suit the application, as can the number of layers.

Also, modifications of the fiber content can be accomplished within each slurry layer. For example, with a fiber volume fraction $V_f$ of 5%, for example, fiber layer 1 optionally has a designated slurry volume fraction of 3% and fiber layer 2 optionally has a designated fiber volume fraction of 2%. Thus, $X_f$ will be ⅔.

The results of panel manufactured using the system of FIG. 6, but using another form of a fiber embedment device, is described in the description and Table 1 of U.S. application Ser. No. 11/555,655, entitled METHOD FOR WET MIXING CEMENTITIOUS SLURRY FOR FIBER-REINFORCED STRUCTURAL CEMENT PANELS, filed Nov. 1, 2006, the disclosure of which is incorporated herein in its entirety.

In the present system 130, by increasing the number of fiber layers, each with its own fiber surface area fraction, more fibers can be added to each slurry layer without requiring as many layers of slurry. Using the above process, the panel 92 can have the same thickness as prior panels, with the same number of fibers of the same diameter, with fewer number of slurry layers. Thus, the resulting panel 92 has layers of enhanced strength but is less expensive to produce, due to a shorter production line using less energy and capital equipment.

TABLE 1

Influence of fiber embedment method on flexural strength

| Panel | Nominal Panel Thickness (inches) | Fiber Volume Fraction (%) | Number of Slurry & Fiber Layers (#) | Panel Manufacturing Method | Modulus of Rupture - 28-day Oven Dry (psi) | |
|---|---|---|---|---|---|---|
| | | | | | Sheep Foot Roller Embedment Method | Two-Dimensional Wire Grid Embedment Method |
| Panel 1 | 1.27 cm. (.50 in.) | 2.0 | 6 | Distinct Slurry & Fiber Layers | 2287 | 2235 |
| Panel 2 | 1.27 cm. (0.50 in.) | 3.0 | 6 | Distinct Slurry & Fiber Layers | 2756 | 3089 |
| Panel 3 | 1.27 cm. (0.50 in.) | 4.0 | 6 | Distinct Slurry & Fiber Layers | 3024 | 3302 |
| Panel 4 | 1.27 cm. (0.50 in.) | 2.0 | 6 | Simultaneous Spray of Slurry & Fibers | 2291 | — |
| Panel 5 | 1.27 cm. (0.50 in.) | 3.0 | 6 | Simultaneous Spray of Slurry & Fibers | 3201 | — |

TABLE 1-continued

| Influence of fiber embedment method on flexural strength | | | | | | |
|---|---|---|---|---|---|---|
| | | | | | Modulus of Rupture - 28-day Oven Dry (psi) | |
| Panel | Nominal Panel Thickness (inches) | Fiber Volume Fraction (%) | Number of Slurry & Fiber Layers (#) | Panel Manufacturing Method | Sheep Foot Roller Embedment Method | Two-Dimensional Wire Grid Embedment Method |
| Panel 6 | 1.27 cm. (0.50 in.) | 4.0 | 6 | Simultaneous Spray of Slurry & Fibers | 3249 | — |

While particular embodiments of an embedment device for a fiber-enhanced slurry have been shown and described, it will be appreciated by those skilled in the art that changes and modifications may be made thereto without departing from the invention in its broader aspects and as set forth in the following claims.

I claim:

1. An embedment device for use in the production of cementitious panels wherein a hydraulic cement slurry is transported on a moving carrier relative to a support frame for the moving carrier, and chopped fibers are deposited upon the slurry, said device comprising;

a wire grid structure having two side wall frames;

a support structure;

the wire grid structure with two side wall frames is mounted to the support structure, wherein the support structure is mounted on the support frame for the moving carrier so the wire grid structure is mounted transversely to the direction of travel of the moving carrier and slurry, and a means on the support structure for moving the wire grid structure up and down in a reciprocating motion for contact with the fiber and slurry layer on the carrier to penetrate the layer from a top surface of the slurry to a bottom surface of the slurry on the moveable carrier to press the fiber into the slurry;

wherein the grid structure is attached to the side wall frames and comprises a number of cross members which intersect in a perpendicular angle to form a rectangular grid with rectangular openings, said number of cross members comprising a first plurality of cross members aligned in a first direction and extending within a perimeter of the grid structure as well as a second plurality of cross members aligned perpendicular to the first direction and extending within a perimeter of the grid structure.

2. The device of claim 1, wherein the means for moving the wire grid up and down in a reciprocating motion comprises a piston associated with the support structure.

3. The device of claim 2, wherein the means for moving the wire grid further comprises an electric motor for operating the piston.

4. The device of claim 2, wherein the means for moving the wire grid further comprises a hydraulic line connected to the piston.

5. The device of claim 2, wherein the means for moving the wire grid further comprises a pneumatic control for controlling the piston.

6. The device of claim 2, wherein the means for moving the wire grid further comprises a manual control for controlling the piston.

7. The device of claim 1, wherein the wire grid is made from metal.

8. The device of claim 1, wherein the wire grid is made from stainless steel.

9. A system comprising:

chopped fibers;

a hydraulic cement slurry; the chopped fibers being upon the slurry;

an embedment device for use in the production of cementitious panels wherein the hydraulic cement slurry is transported on a moving carrier relative to a support frame for the moving carrier, and chopped fibers are deposited upon the slurry, said device comprising;

a wire grid structure having two side wall frames;

a support structure;

the wire grid structure with two side wall frames is mounted to the support structure, wherein the support structure is mounted on the support frame so the wire grid structure is mounted transversely to the direction of travel of the moving carrier and slurry, and a means on the support structure for moving the wire grid structure up and down in a reciprocating motion for contact with the fiber and slurry layer on the carrier to penetrate the layer from a top surface of the slurry to a bottom surface of the slurry on the moveable carrier to press the fiber into the slurry;

wherein the grid structure is attached to the side wall frames and comprises a number of cross members which intersect in a perpendicular angle to form a rectangular grid with rectangular openings, said number of cross members comprising a first plurality of cross members aligned in a first direction and extending within a perimeter of the grid structure as well as a second plurality of cross members aligned perpendicular to the first direction and extending within a perimeter of the grid structure wherein the grid rectangular openings have a grid opening size in a range from about 0.635 cm to 0.8 cm.

10. The device of claim 1, wherein the diameter of the grid wire is about 0.08 cm (0.03 in.) to about 0.51 cm. (0.20 in.), the grid cross members form a grid layer at most the thickness of a wire of the first plurality of cross members plus the thickness of a wire of the second plurality of cross members.

11. The device of claim 5, wherein the diameter of the grid wire is about 0.16 cm to about 0.25 cm., the grid cross members form a grid layer at most the thickness of a wire of the first plurality of cross members plus the thickness of a wire of the second plurality of cross members.

12. An embedment device for use in the production of cementitious panels wherein a hydraulic cement slurry is transported on a moving carrier relative to a support frame, and chopped fibers are deposited upon the slurry, said device comprising:

a grid cell structure having two side wall frames;

a support structure;

wherein the grid cell structure with two side wall frames is mounted to the support structure, wherein the support structure is mounted on the sides of a conveyor carrying the carrier and the slurry so the grid cell structure is mounted transversely to the direction of travel of the carrier and the slurry, and a means on the support structure for moving the grid cell structure up and down in a reciprocating motion for contact with a fiber and slurry layer on the carrier to penetrate the layer from a top surface of the slurry to a bottom surface of the slurry on the moveable carrier to press the fiber into the slurry before removing the grid cell from the slurry;

wherein the grid cell structure is attached to the side wall frames and comprises a number of cross members which intersect in a perpendicular angle to form rectangular grid cells, said number of cross members comprising a first plurality of cross members aligned in a first direction and extending within a perimeter of the grid cell structure as well as a second plurality of cross members aligned perpendicular to the first direction and extending within a perimeter of the grid cell structure.

13. The device of claim 12, wherein the means for moving the grid cell up and down in a reciprocating motion comprises a piston associated with the support structure.

14. The device of claim 13, wherein the means for moving the grid cell further comprises an electric motor for operating the piston.

15. The device of claim 13, wherein the means for moving the grid cell further comprising a hydraulic line connected to the piston.

16. The device of claim 13, wherein the means for moving the grid cell further comprises pneumatic control for controlling the piston.

17. The device of claim 13, wherein the means for moving the grid cell further comprises manual control for controlling the piston.

18. The device of claim 12, wherein the grid cell is made from a material selected from the group consisting of metal, rigid plastic and fiber reinforced plastic, the cross members lying in a same plane.

19. The device of claim 12, comprising means for regulating speed of the reciprocating motion of the grid cell down into the slurry based upon the line speed of the slurry on the conveyor belt to ensure multiple pressing of the grid cell into each layer of fiber and slurry.

20. The device of claim 12, wherein a thickness of wall of the grid cell structure is greater than or equal to about 0.08 cm. (0.03 inches) to about 0.51 cm (0.20 inches).

21. The device of claim 12, wherein a thickness of the wall of the grid cell structure is greater than or equal to about 0.16 cm (0.06 inches) to about 0.25 cm (0.10 inches).

22. The device of claim 21, wherein walls of the grid cell structures are made from a non-stick material.

23. The device of claim 12, wherein the means for moving the grid cell up and down in a reciprocating motion comprises a piston associated with the support structure, wherein the cell openings have a size in a range of about 0.635 to 0.8 cm.

24. The device of claim 3, wherein the grid openings have a grid opening size in a range from about 0.635 cm to 0.8 cm.

* * * * *